US010843772B2

(12) United States Patent
Willis et al.

(10) Patent No.: US 10,843,772 B2
(45) Date of Patent: Nov. 24, 2020

(54) COLLAPSIBLE WATERCRAFT WITH TANDEM AND SINGLE-SEAT CONFIGURATIONS

(71) Applicant: Oru Designs, LLC, Emeryville, CA (US)

(72) Inventors: Anton Michael Willis, Oakland, CA (US); Forrest Nelson Harvey, Oakland, CA (US); Stefania Cargnello, San Francisco, CA (US)

(73) Assignee: Oru Designs, LLC, Emeryville, CA (US)

( * ) Notice: Subject to any disclaimer, the term of this patent is extended or adjusted under 35 U.S.C. 154(b) by 0 days.

(21) Appl. No.: 16/453,000

(22) Filed: Jun. 26, 2019

(65) Prior Publication Data

US 2019/0389541 A1 Dec. 26, 2019

Related U.S. Application Data

(60) Provisional application No. 62/690,293, filed on Jun. 26, 2018.

(51) Int. Cl.

| | |
|---|---|
| ***B63B 7/02*** | (2020.01) |
| ***B63B 34/20*** | (2020.01) |
| *B63B 34/26* | (2020.01) |

(52) U.S. Cl.

CPC ..... *B63B 7/02* (2013.01); *B63B 34/20* (2020.02); *B63B 34/26* (2020.02)

(58) Field of Classification Search

CPC .. B63B 7/02; B63B 7/06; B63B 34/20; B63B 34/26

See application file for complete search history.

(56) References Cited

U.S. PATENT DOCUMENTS 3,416,170 A * 12/1968 Dohet ..... B63B 7/06 114/354

5,842,495 A 12/1998 Egnew et al.

(Continued)

FOREIGN PATENT DOCUMENTS

DE 20 2013 008 654 U1 11/2013

GB 479256 A 2/1938

(Continued)

OTHER PUBLICATIONS

U.S. Receiving Office, International Search Report and Written Opinion of the International Searching Authority, dated Oct. 31, 2016, in PCT/US2016/032669.

(Continued)

*Primary Examiner* — Stephen P Avila

(74) *Attorney, Agent, or Firm* — Kolitch Romano LLP

(57) ABSTRACT

A collapsible watercraft comprises a foldable sheet and is transitionable between a deployable kayak configuration and a stowed configuration by folding or unfolding along predefined fold lines in the foldable sheet. In the kayak configuration, the watercraft is switchable between at least a single-seat configuration and a tandem configuration by installing a desired number of seat and footrest assemblies. At least some of the seat and footrest assemblies are installed in the kayak by strapping seat and/or footrest components to loops nonreleasably attached to removable floorboards of the kayak. The removable floorboards are installed in the kayak using extruded engagement profiles.

20 Claims, 19 Drawing Sheets

(56) References Cited

U.S. PATENT DOCUMENTS

| | | | | |
|---|---|---|---|---|
| 6,006,691 | A | 12/1999 | Wilce | |
| 6,367,403 | B1 * | 4/2002 | Carter | A01K 97/06 114/343 |
| 6,615,762 | B1 | 9/2003 | Scott | |
| 8,316,788 | B2 | 11/2012 | Willis | |
| 10,322,774 | B2 | 6/2019 | Willis | |
| 2011/0017121 | A1 | 1/2011 | Willis | |
| 2016/0257378 | A1 | 9/2016 | Jin et al. | |

FOREIGN PATENT DOCUMENTS

| | | | | |
|---|---|---|---|---|
| KR | 101368334 | B1 | 3/2014 | |
| WO | WO-2016187104 | A1 * | 11/2016 | B63B 3/48 |

OTHER PUBLICATIONS

U.S. Patent and Trademark Office, Office action, dated Mar. 7, 2018, in U.S. Appl. No. 15/860,541.

U.S. Patent and Trademark Office, Office action, dated Oct. 30, 2018, in U.S. Appl. No. 15/574,471.

Korean Intellectual Property Office, Office action, dated Dec. 27, 2018, in Patent Application 10-2017-7035989.

* cited by examiner

COLLAPSIBLE WATERCRAFT WITH TANDEM AND SINGLE-SEAT CONFIGURATIONS

CROSS-REFERENCES

This application claims the benefit under 35 U.S.C. § 119(e) of the priority of U.S. Provisional Patent Application Ser. No. 62/690,293, filed Jun. 26, 2018, the entirety of which is hereby incorporated by reference for all purposes.

FIELD

This disclosure relates to systems and methods for collapsible watercraft. Specifically, this disclosure relates to foldable kayaks.

INTRODUCTION

Kayaks and other lightweight, personal watercraft are popular for recreational use on rivers, lakes, oceans, and other suitable locations. Collapsible watercraft may be especially convenient in at least some cases due to the ease with which they can be transported and stored. For example, a foldable kayak may be folded into a relatively small configuration when not in use on the water. In the folded state, the foldable kayak is less cumbersome to carry than a conventional kayak, and requires less space to store. Various aspects of the foldable kayak's design impact the ease of assembling the kayak, the robustness of the assembled kayak, and the suitability of the kayak for different types of use. Types of use may include, for example, kayaking with different numbers of passengers, or during activities requiring use and/or storage of equipment (e.g., photography, fishing, hunting, etc.). Better solutions for at least these aspects of foldable kayaks and other collapsible watercraft are needed.

SUMMARY

The present disclosure provides systems, apparatuses, and methods relating to collapsible watercraft.

In some embodiments, a collapsible watercraft comprises a foldable sheet configured to transition, by folding or unfolding along a plurality of predefined fold lines, between a stowed state and an assembled state wherein the foldable sheet forms a body of the watercraft; a pair of midship side portions of the foldable sheet configured to define a cockpit when the foldable sheet is in the assembled state; and a first removable floorboard configured to overlap a first portion of a cockpit floor and a second removable floorboard configured to overlap a second portion of the cockpit floor; wherein the first and second floorboards are configured to form opposing lids at least partially enclosing the foldable sheet when the foldable sheet is in the stowed state.

In some embodiments, a collapsible watercraft transitionable between a collapsed state and a deployed state comprises a foldable sheet having a plurality of predefined creases, the foldable sheet forming a body of the collapsible watercraft in the deployed state, with opposed deck panels of the foldable sheet foldable inwardly toward each other about a longitudinal axis of the foldable sheet and brought together to form the deployed state; and a fin portion hingedly connected to a first one of the deck panels of the foldable sheet at one of the predefined creases and configured to pivot about the crease when the collapsible watercraft is in the deployed state to selectively either partially overlap an opposing second one of the deck panels of the foldable sheet, or to expose an interior portion of the collapsible watercraft.

In some embodiments, a foldable kayak having a body formed of a foldable skin comprises opposing midship side portions defining a cockpit, each midship side portion having fold lines defining a respective gunwale portion and a respective cockpit flap; a floorboard including a medial portion shaped to at least partially conform to the body between the opposing midship side portions, and a pair of lateral portions each disposed on a respective side of the medial portion; and a pair of engagement members each configured to connect to one of the cockpit flaps and to one of the lateral portions of the floorboard, such that a longitudinally extending space is defined between each of the lateral portions of the floorboard and the corresponding midship side portion.

In some embodiments, a collapsible watercraft formed of a foldable skin and transitionable between an assembled state and a stowed state, the foldable skin defining a body of the collapsible watercraft when the collapsible watercraft is in the assembled state, comprises opposing midship side portions of the foldable skin defining a cockpit, a respective gunwale flap hingedly connected to each midship side portion, and a respective cockpit flap hingedly connected to each gunwale flap; a removable floorboard having a central portion and a pair of lateral portions hingedly connected to opposing lateral edges of the central portion, wherein the central portion is configured to at least partially conform to a floor of the cockpit when the collapsible watercraft is in the assembled state; and a pair of longitudinally extending engagement members each configured to releasably secure one of the cockpit flaps to one of the lateral portions of the floorboard, such that when the collapsible watercraft is in the assembled state, each lateral portion of the floorboard, the corresponding cockpit flap, and the corresponding gunwale flap together form a hollow beam extending along the cockpit.

In some embodiments, a foldable kayak having a body formed of a single foldable skin comprises a pair of cockpit outer side walls disposed on opposing sides of a cockpit; and a first floorboard configured to overlap a first portion of a cockpit floor and a second floorboard configured to overlap a second portion of the cockpit floor; wherein the first floorboard has a first seat attachment device configured to releasably attach a first seat to the first floorboard, and the second floorboard has a second seat attachment device configured to releasably attach a second seat to the second floorboard.

In some embodiments, a collapsible watercraft configured to transition between a collapsed state and a deployed state, and configured to accommodate either a single-passenger seat assembly or a tandem seat assembly in the deployed state, comprises a foldable sheet having a plurality of predefined creases, the foldable sheet forming a body of the collapsible watercraft in the deployed state; a pair of opposing midship side portions of the foldable sheet defining a cockpit; a first removable floorboard configured to sit in a first portion of the cockpit; and a second removable floorboard configured to sit in a second portion of the cockpit; wherein the first removable floorboard is configured to engage a first seat of the tandem seat assembly, and the second removable floorboard is configured to engage either a second seat of the tandem seat assembly or a single seat of the single-passenger seat assembly.

Features, functions, and advantages may be achieved independently in various embodiments of the present disclosure, or may be combined in yet other embodiments, further details of which can be seen with reference to the following description and drawings.

DETAILED DESCRIPTION

Figure 1:
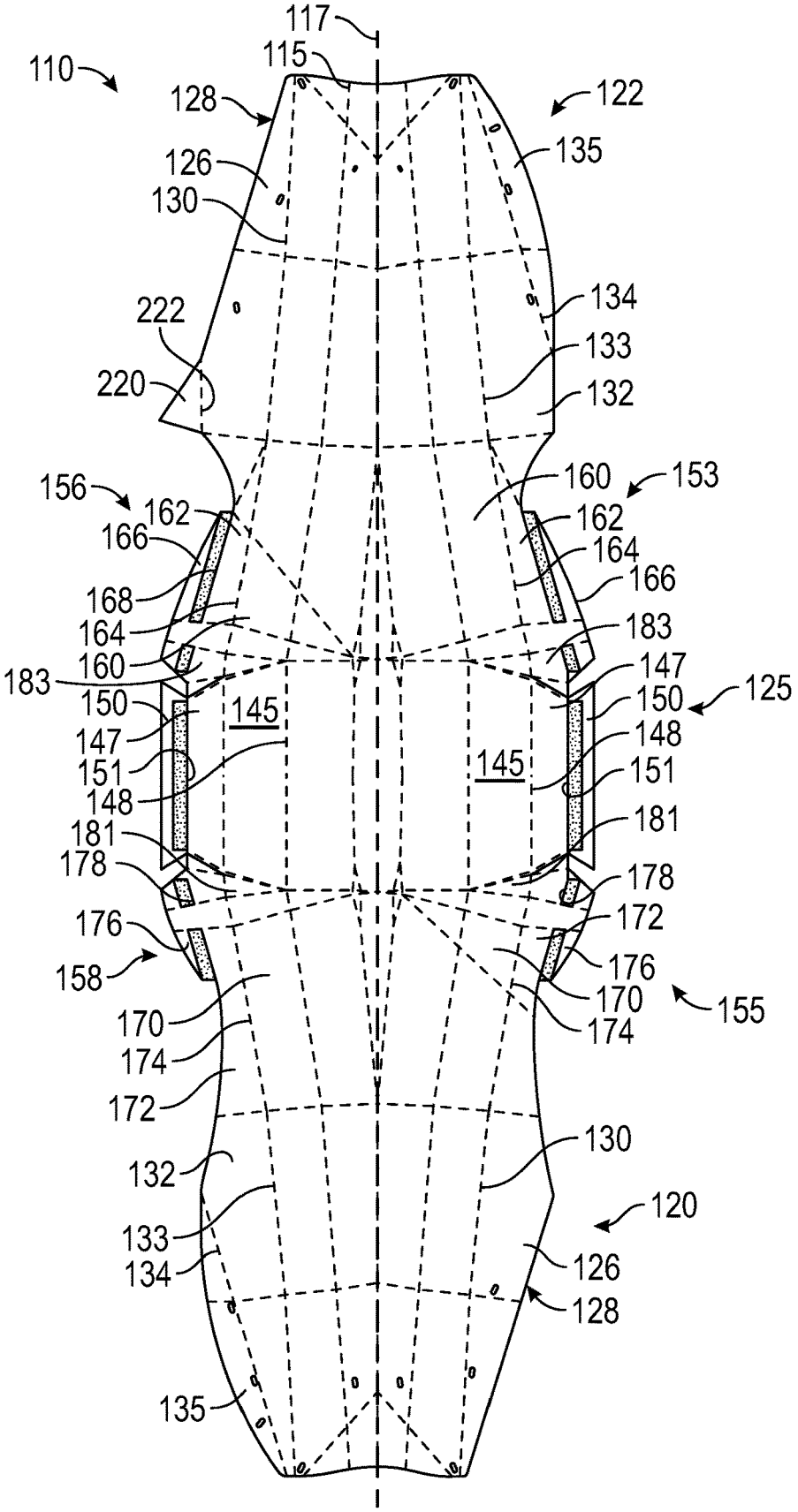
FIG. 1 is a top view of an illustrative foldable sheet which is foldable along predefined fold lines to form a kayak, in accordance with aspects of the present teachings.

Various aspects and examples of collapsible watercraft, as well as related methods, are described below and illustrated in the associated drawings. Unless otherwise specified, collapsible watercraft in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections A through E, each of which is labeled accordingly.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

The terms "inboard," "outboard," "forward," "rearward," and the like are intended to be understood in the context of a host watercraft on which systems described herein may be mounted or otherwise attached. For example, "outboard" may indicate a relative position that is laterally farther from the centerline of the watercraft, or a direction that is away from the watercraft centerline. Conversely, "inboard" may indicate a direction toward the centerline, or a relative position that is closer to the centerline. Similarly, "forward" and "fore" mean toward the front portion of the watercraft (e.g., the bow), and "aft" means toward the rear of the watercraft (e.g., the stern). In the absence of a host watercraft, the same directional terms may be used as if the watercraft were present. For example, even when viewed in isolation, a device may have a "forward" edge, based on the fact that the device would be installed with the edge in question facing in the direction of the bow of the host watercraft.

"Coupled" means connected, either permanently or releasably, whether directly or indirectly through intervening components.

"Resilient" describes a material or structure configured to respond to normal operating loads (e.g., when compressed) by deforming elastically and returning to an original shape or position when unloaded.

"Rigid" describes a material or structure configured to be stiff, non-deformable, or substantially lacking in flexibility under normal operating conditions.

"Elastic" describes a material or structure configured to spontaneously resume its former shape after being stretched or expanded.

Overview

In general, a collapsible watercraft in accordance with the present teachings comprises a foldable sheet configured to transition between a stowed state and a deployable (or assembled) state by folding or unfolding along a plurality of predefined fold lines. In the stowed state, the foldable sheet may form a self-contained carrying case, which is more convenient to transport that a conventional watercraft. In the deployable state, the foldable sheet forms a body (e.g., a hull, deck, and/or sides) of the watercraft. The body includes a pair of opposing midship side portions of the watercraft defining a cockpit.

In some examples, the bow and stern portions of the watercraft each include deck panels configured to overlap each other in the deployable state. In some examples, a fin-shaped portion of the sheet extends from a side of at least one of the deck panels and is configured to fold a crease defined at the side of the panel. In this manner, the fin extends the watercraft deck in the deployable state, but does not significantly increase the volume occupied by the folded sheet in the stowed state. In the deployable state, the fin may comprise a hatch selectively covering a storage space in the watercraft body.

In some examples, the collapsible watercraft includes at least one removable floorboard configured to be installed in the cockpit. When installed in the cockpit, the floorboards provide structural support to the kayak at the cockpit and, in at least some examples, provide mechanisms for attaching and supporting one or more passenger seats.

The floorboard(s) include a medial portion and a pair of lateral portions hingedly connected (e.g., via predefined creases) to opposing sides of the medial portion. In some examples, the medial portion and/or lateral the lateral portions include additional creases and/or darts enabling them to at least partially conform to the body of the watercraft. In examples wherein the watercraft includes more than one removable floorboard, the floorboards may be identical, or they may be different. For example, each of the floorboards may be creased in a different manner (e.g., to facilitate conforming to different portions of the watercraft body, and/or to achieve respective shapes that conform to the body to different extents).

The lateral portions of the floorboard(s) are configured to be connected to midship side portions of the watercraft via one or more respective engagement members. Each engagement member comprises an extruded profile extending longitudinally along a side of the cockpit. The engagement members may be fixed to the floorboard and configured to selectively engage the foldable sheet, or fixed to the foldable sheet and configured to selectively engage the floorboard. In some examples, two or more engagement profiles are attached to each side of the cockpit and are spaced from each other by gaps. This facilitates folding the watercraft into the stowed state.

In some examples, the engagement members are configured to receive an attachment portion of an accessory for the watercraft. For example, the engagement members may have a longitudinal channel shaped to receive a fastener that retains an accessory against the profile.

In some examples, the one or more floorboards are configured to enable the watercraft to be transitioned from a single-seat configuration to a two-seat configuration (AKA a tandem configuration). For example, the floorboard(s) may include a plurality of seat attachment devices each configured to releasably secure a seat, or component of a seat, to the floorboard, and a user may install one or two (or more) seats as desired. Suitable attachment devices may include slots, clamps, threaded bores, and/or other suitable receptacles configured to receive a complementary attachment portion of a removable seat.

In some examples, each seat includes a seat back and a separate seating surface, and installing the seat in the watercraft includes independently attaching the seat back and the seating surface to the appropriate floorboard. For example, the seat back may include a tab configured to be received in a slot in the floorboard, and the seating surface may be configured to be retained against the floorboard by an elastic cord. The floorboard may further include a plurality of straps, buckles, and/or loops disposed on medial and/or lateral portions of the floorboard and configured to receive hooks attached to the seats and/or to footrests.

In some examples, the collapsible watercraft includes two removable floorboards that are configured to at least partially cover the folded foldable sheet in the stowed configuration. For example, the foldable sheet may fold into a generally rectangular box shape when in the stowed configuration, and the floorboards may be folded around the box (e.g., such that the medial floorboard portions cover top and bottom surfaces of the box, and the lateral floorboard portions extend along sides of the box). In some examples, the floorboards are securable in place about the stowed sheet using straps and buckles that, when the watercraft is in the deployable state, are used to secure the floorboard to the foldable sheet, to secure seats to the floorboard, and/or to secure footrests to the floorboards and/or seats.

In some examples, the collapsible watercraft comprises a kayak. Alternatively, the collapsible watercraft may comprise a canoe, a rowing boat, a raft or rafting boat, and/or any other suitable non-motorized or motorized watercraft.

Examples, Components, and Alternatives

The following sections describe selected aspects of exemplary collapsible watercraft, as well as related systems and/or methods. The examples in these sections are intended for illustration and should not be interpreted as limiting the scope of the present disclosure. Each section may include one or more distinct embodiments or examples, and/or contextual or related information, function, and/or structure.

A. Illustrative Foldable Kayak

With reference to FIGS. 1-17, this section describes an illustrative foldable kayak 100. Kayak 100 is an example of a collapsible watercraft, as described above.

Figure 2:
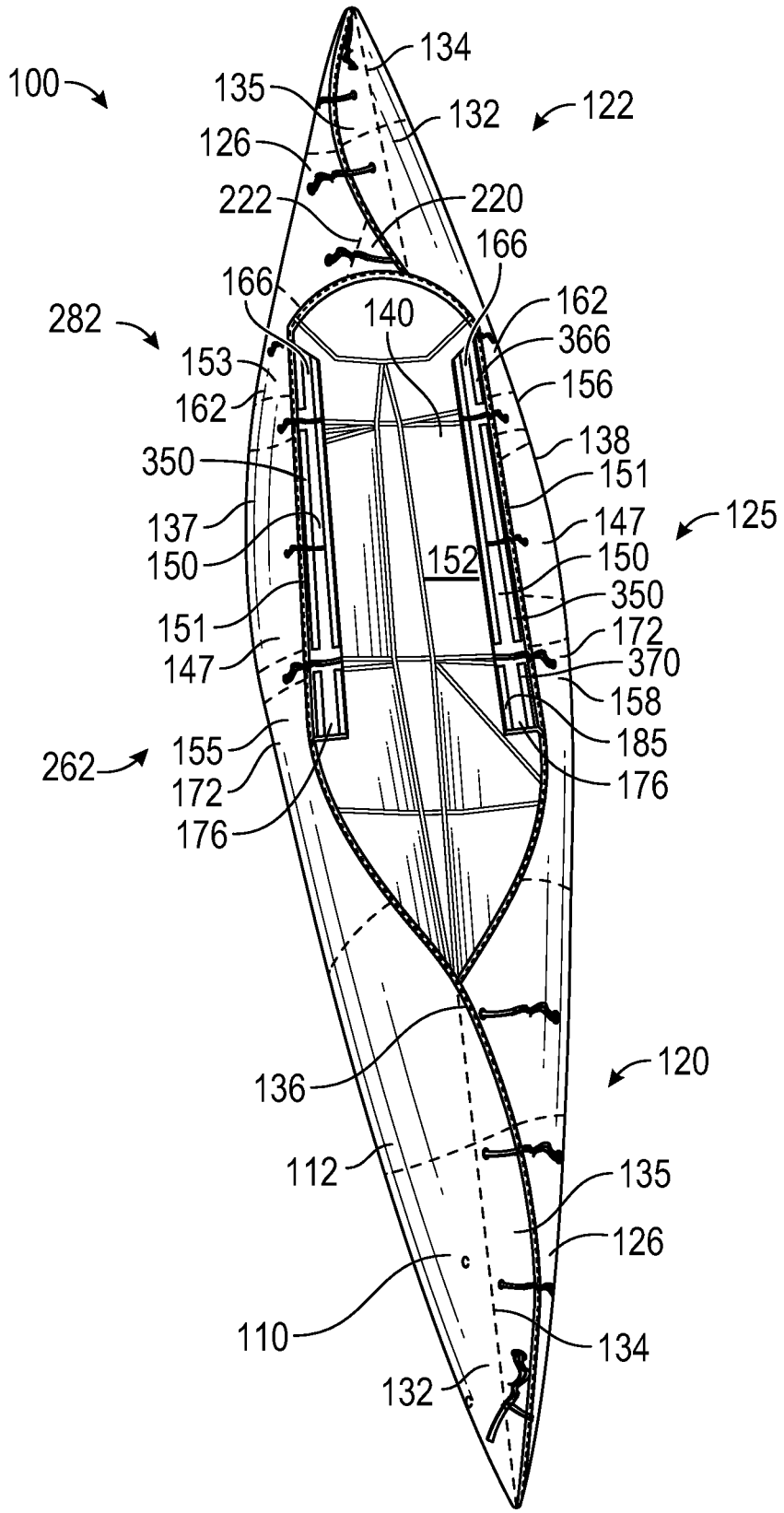
FIG. 2 is an isometric view of a kayak formed by the foldable sheet of FIG. 1, in accordance with aspects of the present teachings.

FIG. 1 is a top view of an illustrative foldable sheet 110 in an unfolded state, and FIG. 2 is an isometric view of kayak 100 (e.g., with foldable sheet 110 folded into a kayak body 112, in a deployable state). Foldable sheet 110, also referred to as a skin or a main panel, is an example of the foldable sheet described above. Foldable sheet 110 is made of a strong flexible material suitable for being deployed in water and for having a plurality of predefined fold lines 115, also referred to as creases or living hinges. Fold lines 115 comprise creases along which foldable sheet 110 is configured to fold. Suitable materials for foldable sheet 110 may include, for example, hollow-core sheets of corrugated and/or honeycomb polypropylene and/or polyethylene, although other waterproof, resilient materials may be used. Foldable sheet 110 is configured to be assembled (e.g., to form kayak 100) by folding along fold lines 115. In the assembled state (AKA the deployable state), foldable sheet 110 forms body 112 (e.g., a hull, deck, and/or sides) of kayak 100. Foldable sheet 110 defines a longitudinal axis 117.

As shown in FIG. 2, kayak 100 has a front or bow portion 120, a rear or stern portion 122, and a midship portion 125 extending between the bow and stern portions. Portions of foldable sheet 110 corresponding to bow portion 120, stern portion 122, and midship portion 125 are also indicated in FIG. 1. Bow portion 120 and stern portion 122 each include a first deck panel 126 defined between an edge 128 of foldable sheet 110 and a fold line 130 in the foldable sheet. Bow portion 120 and stern portion 122 each further include a second deck panel 132 opposing the corresponding first deck panel 126. Second deck panels 132 each are substantially defined between two fold lines 133 and 134. A respective curved deck panel 135 is hingedly connected to each second deck panel 132 at fold line 134.

As shown in FIG. 2, when kayak 100 is in the assembled configuration, first deck panel 126 and second deck panel 132 in both the bow portion and the stern portion are brought together such that curved deck panel 135 at least partially overlaps the first deck panel. Straps and buckles attached to the first deck panels, second deck panels, and/or curved deck panels extend over the curved deck panels to releasably secure the curved deck panel to the first deck panel. A resilient edge fitting 136 attached to edges of curved deck panel 135 and first deck panel 126 is compressed when the straps hold the deck panels together, forming a substantially water-tight seal. The overlap of curved deck panel 135 and first deck panel 126 allows each of the bow and stern portions of the kayak to be formed without precisely aligning any edges of foldable sheet 110, thereby increasing the ease of assembly of the kayak.

In illustrative kayak 100, curved deck panel 135 of bow portion 120 is disposed on a starboard or right edge of foldable sheet 110, and curved deck panel 135 of stern portion 122 is disposed on a port or left edge of the foldable sheet. In other examples, however, the bow curved deck panel may extend from the port edge and the stern curved deck panel may extend from the starboard edge, or the curved deck panels may both extend from the starboard or port edge of the sheet.

Figure 3:
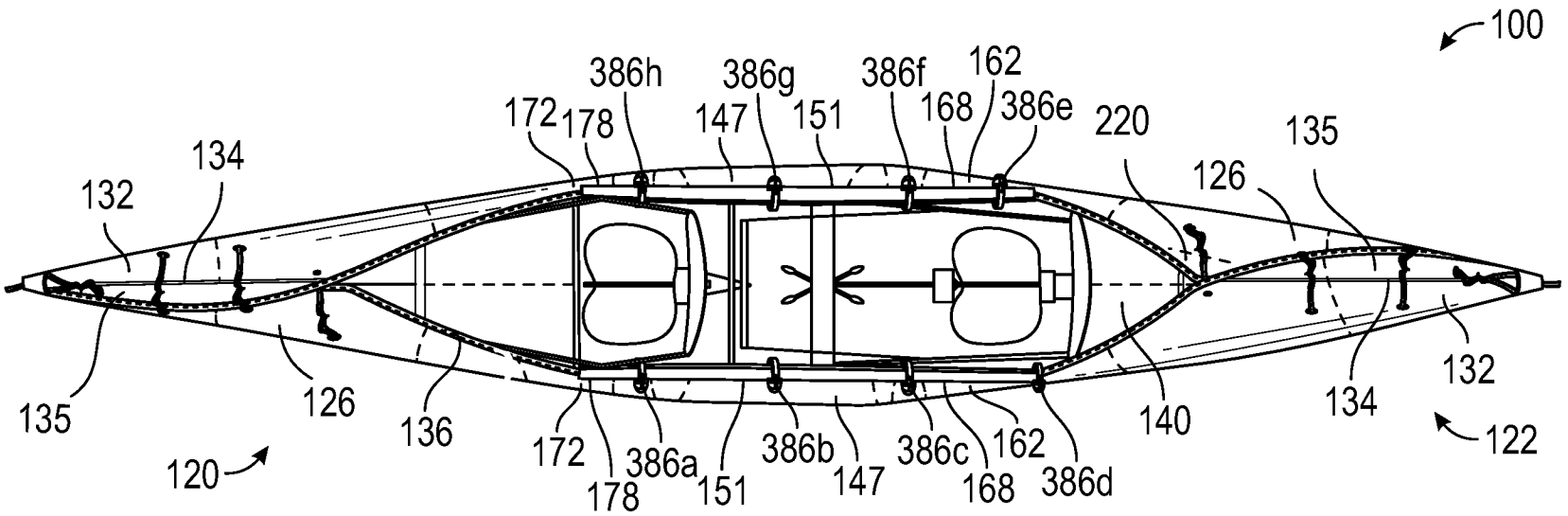
FIG. 3 is a top view of the kayak of FIG. 2 with illustrative removable floorboards and seats installed, in accordance with aspects of the present teachings.

Midship portion 125 includes a pair of opposing midship side portions 137, 138 defining between them a cockpit 140. Each midship side portion 137, 138 includes a midship outer panel 145 (see FIG. 1), a midship gunwale panel 147 hingedly connected to the midship outer panel at a fold line 148, and a midship cockpit flap 150 hingedly connected to the midship gunwale panel at a fold line 151. In the assembled state, outer panels 145 form outer walls of the kayak hull, gunwale panels 147 form gunwales of the kayak, and cockpit flaps 150 fold down into cockpit 140 toward a cockpit floor 152. Cockpit flaps 150 are configured to attach to floorboard(s) of the kayak, as described in further detail below. FIG. 2 depicts cockpit 140 without floorboards, and FIG. 3 depicts the cockpit with floorboards installed.

Midship side portion 137 further includes a rear midship portion 153 and a front midship portion 155, and midship side portion 138 includes a rear midship portion 156 and a front midship portion 158. Rear midship portions 153, 156 each include a rear outer panel 160, a rear gunwale panel 162 hingedly connected to the rear outer panel at a fold line 164, and a rear cockpit flap 166 hingedly connected to the rear gunwale panel at a fold line 168. Front midship portions 155, 158 each include a front outer panel 170, a front gunwale panel 172 hingedly connected to the front outer panel at a fold line 174, and a front cockpit flap 176 hingedly connected to the front gunwale panel at a fold line 178.

As shown in FIG. 1, a respective front dart fold 181 connects each outer panel 145 to the corresponding front outer panel 170 and connects each gunwale panel 147 to the corresponding front gunwale panel 172. A respective rear dart fold 183 connects each outer panel 145 to the corresponding rear outer panel 160 rear outer panel 160 and connects each gunwale panel 147 to the corresponding rear gunwale panel 162. The dart folds facilitate folding foldable sheet 110 into the stowed configuration.

Resilient edge fittings 185 may be disposed along edges of midship cockpit flaps 150, rear cockpit flaps 166, and/or front cockpit flaps 176.

As shown in FIG. 3, which is a top view, when kayak 100 is in the assembled state, each set of fold lines 151, 168, and 178 form a substantially straight, contiguous line, such that cockpit 140 has substantially parallel edges all along the length of the cockpit. This gives the cockpit a substantially uniform width, which provides some flexibility in the placement of seats, footrests, and/or other accessories in or adjacent the cockpit. Dart folds 181 and 183 (see FIG. 1) enable midship side portions 137, 138 to fold, so that the length of the kayak in its folded configuration need not be as long as the cockpit in the assembled state.

In the depicted example, rear midship portions 153, 156 are longer than front midship portions 155, 158. In other words, the rear midship portions extend a greater distance in a generally longitudinal direction than do the front midship portions. This structure may help to support occupants at desired positions in forward and aft portions of cockpit 140. Some typical seating positions are described below.

Figure 4:
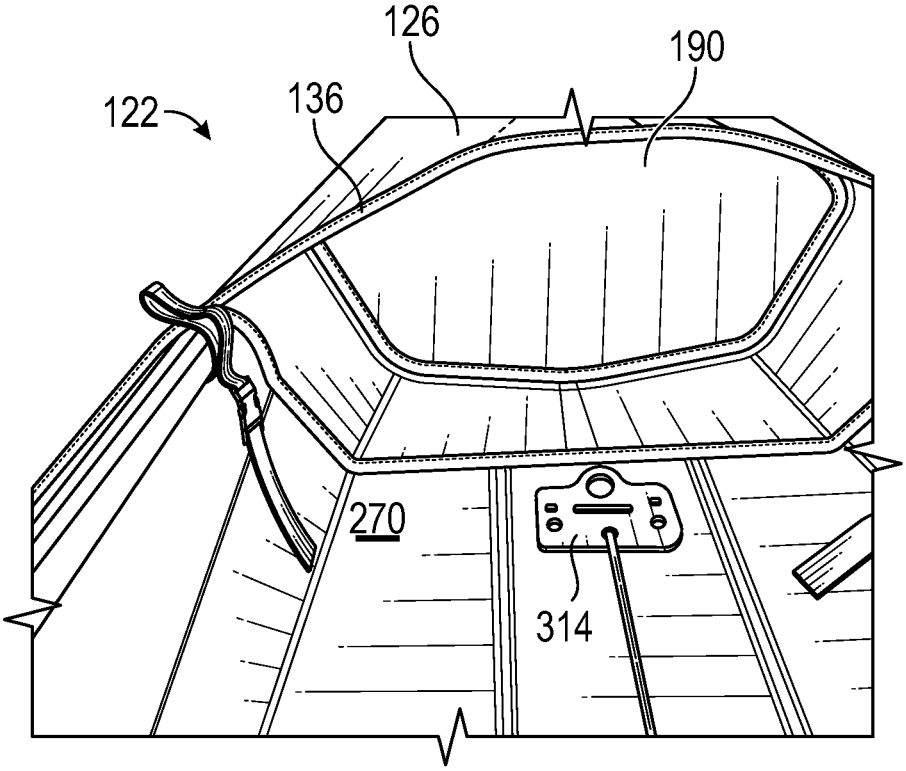
FIG. 4 is an isometric view depicting an illustrative removable bulkhead installed in a stern portion of the kayak of FIG. 2.
Figure 5:
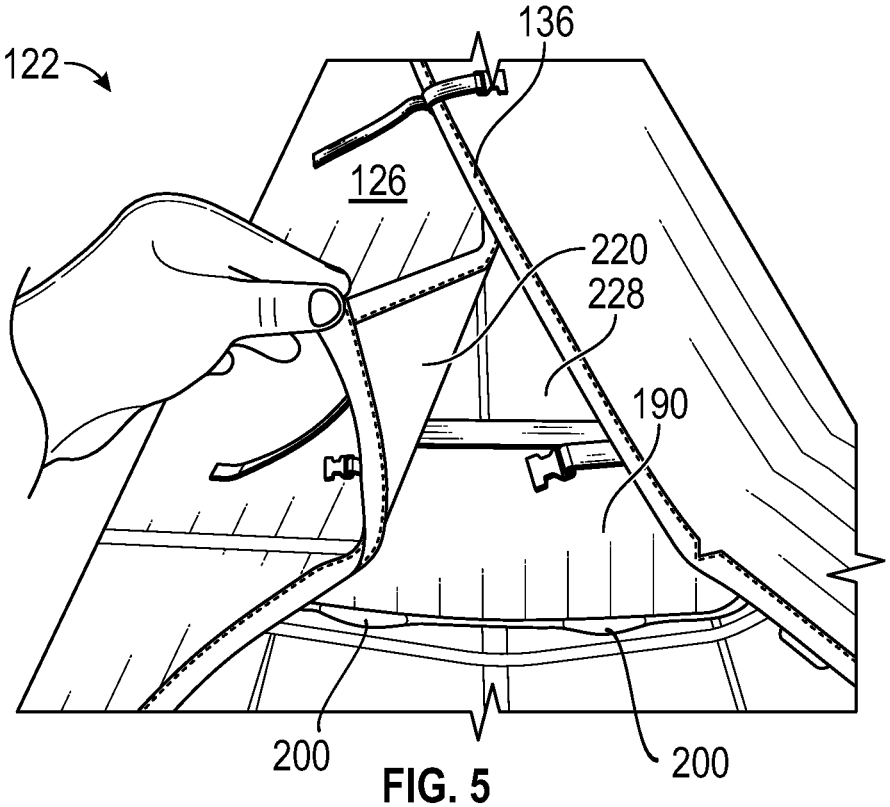
FIG. 5 is an isometric view of the stern portion of the kayak of FIG. 2, depicting an illustrative fin portion of the foldable sheet.

FIGS. 4-5 are isometric views of stern portion 122 of kayak 100. As these views show, a stern bulkhead 190 can be releasably secured in stern portion 122 to increase the structural integrity of the stern portion. Stern bulkhead 190 comprises a sheet having a size and shape substantially equal to a cross-sectional shape of stern portion 122 when the kayak is in its deployed configuration. This allows stern bulkhead 190 to be installed in stern portion 122 in an orientation generally transverse to longitudinal axis 117, with edges of the bulkhead contacting inner walls of the stern portion, thereby structurally supporting the kayak and tending to prevent water ingress behind the bulkhead.

Figure 6:
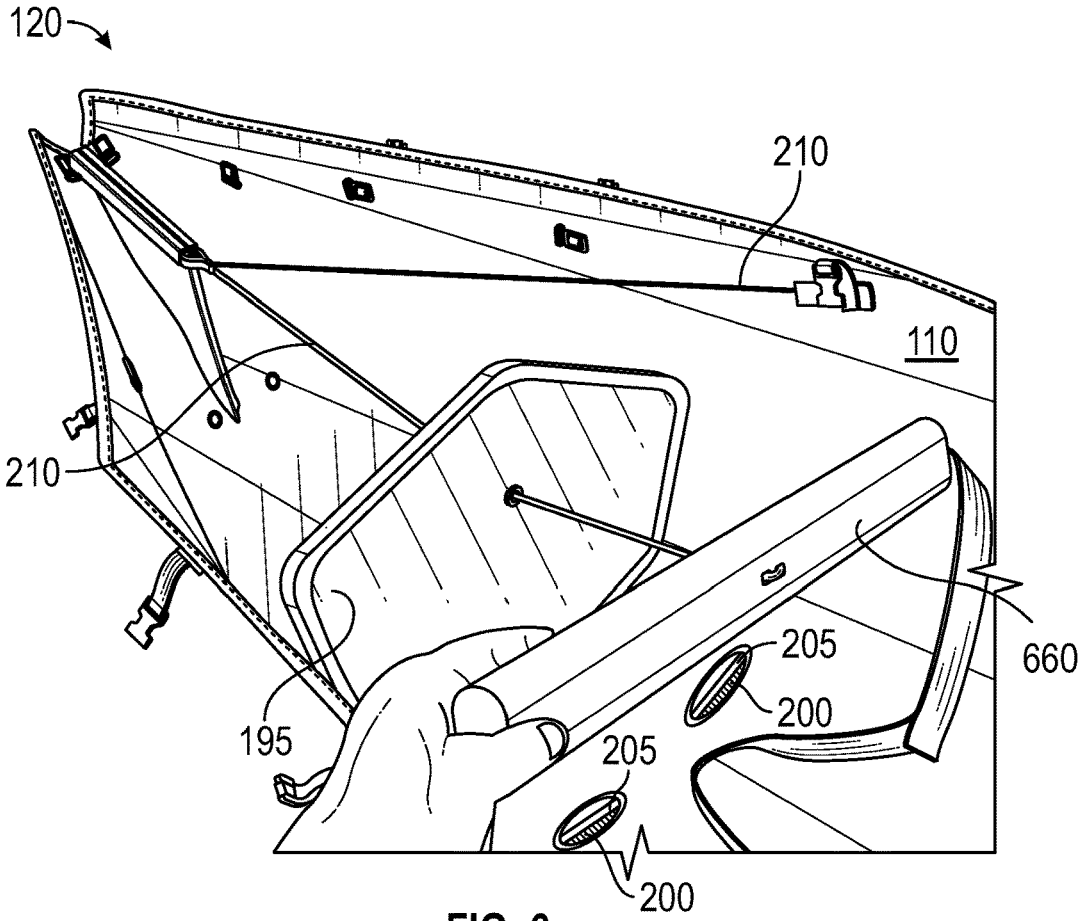
FIG. 6 is an isometric view of a bow portion of the kayak of FIG. 2, with the kayak partially disassembled to show another illustrative bulkhead and an illustrative footrest in accordance with aspects of the present teachings.

FIG. 6 is an isometric view depicting a bow bulkhead 195 partially installed in bow portion 120. Bow bulkhead 195 can be releasably secured in bow portion 120 when the kayak is in its deployed configuration, to provide structural support to the bow portion. In the depicted example, bow bulkhead 195 and stern bulkhead 190 have different shapes and sizes. This enables bow bulkhead 195 to be installed farther from midship portion 125 than is stern bulkhead 190, providing room for the legs of a kayak occupant sitting near the bow end of cockpit 140. In other examples, however, the bow bulkhead is not positioned further from the midship portion than is the stern bulkhead, and in general the bulkheads may be configured to be positioned at any desired locations, or in some cases at multiple possible locations. In some examples, the bow bulkhead and/or the stern bulkhead are omitted.

Bow bulkhead 195 and stern bulkhead 190 optionally may each be retained within kayak 100 by a respective pair of bulkhead channels 200. Each bulkhead channel 200 is attached or attachable to foldable sheet 110 and includes a slot 205 configured to receive an edge of the corresponding bulkhead. In this manner, bulkhead channels 200 tend to hold the bulkhead upright within the kayak. In other examples, there may be a different number of bulkhead channels, or the bulkhead channels may be omitted and the bulkheads may be attached to the kayak in another way. FIG. 4 depicts stern bulkhead 190 installed without bulkhead channels 200, and FIG. 5 depicts the stern bulkhead installed with bulkhead channels.

As shown in FIG. 6, bow bulkhead 195 of the depicted embodiment is connected nonreleasably to foldable sheet 110 by a cable 210 passing through an aperture in the bulkhead. This prevents loss of the bow bulkhead (e.g., when the kayak is in the stowed state or is being assembled or disassembled). In this example, stern bulkhead 190 is not attached to foldable sheet 110 by a cable or any other nonreleasable mechanism. In other examples, however, the stern bulkhead may be nonreleasably attached to the sheet, or the bow bulkhead may not be nonreleasably attached to the sheet, or both. Cable 210 may also be connected to other components of the kayak such as a footrest, as described further below.

Returning to FIG. 5, foldable sheet 110 includes a fin portion 220. Fin portion 220 is hingedly connected to one of the first deck panels 126 and configured to fold relative to the first deck panel at a fold line 222 (see FIG. 1). Fin portion 220 provides extra width to the kayak deck without significantly increasing the width of the first deck panel. When kayak 100 is in the stowed configuration, fin portion 220 folds easily down into the folded sheet (see FIGS. 26-27 and further description below). Accordingly, fin portion 220 increases the width of the deck of the assembled kayak while increasing the volume of the folded kayak relatively little.

In the example depicted here, fin portion 220 is disposed at stern portion 122 of kayak 100, and therefore forms a portion of the kayak deck behind the cockpit. In other examples, a fin portion may be additionally or alternatively disposed at bow portion 120. Fin portion 220 is substantially triangular in shape, but in other examples, one or more fin portions may have any other shape suitable for extending the deck width. In yet other examples, the fin portion may be omitted.

As shown in FIG. 5, fin portion 220 forms an access door or flap selectively covering a storage space 228 defined between stern bulkhead 190 and stern portion 122 of foldable sheet 110. A kayak user may store gear, supplies, and/or any other suitable items in storage space 228 while kayak 100 is in the deployable state. Fin portion 220 can be pivoted about fold line 222 to cover or uncover storage space 228 while the kayak is in use without fully or partially disassembling the kayak (e.g., without unfastening curved deck panels 135 from first deck panels 126). Thus, the fin portion provides convenient access to items stored in the storage space, while the kayak remains in a seaworthy, deployed configuration.

Figure 7:
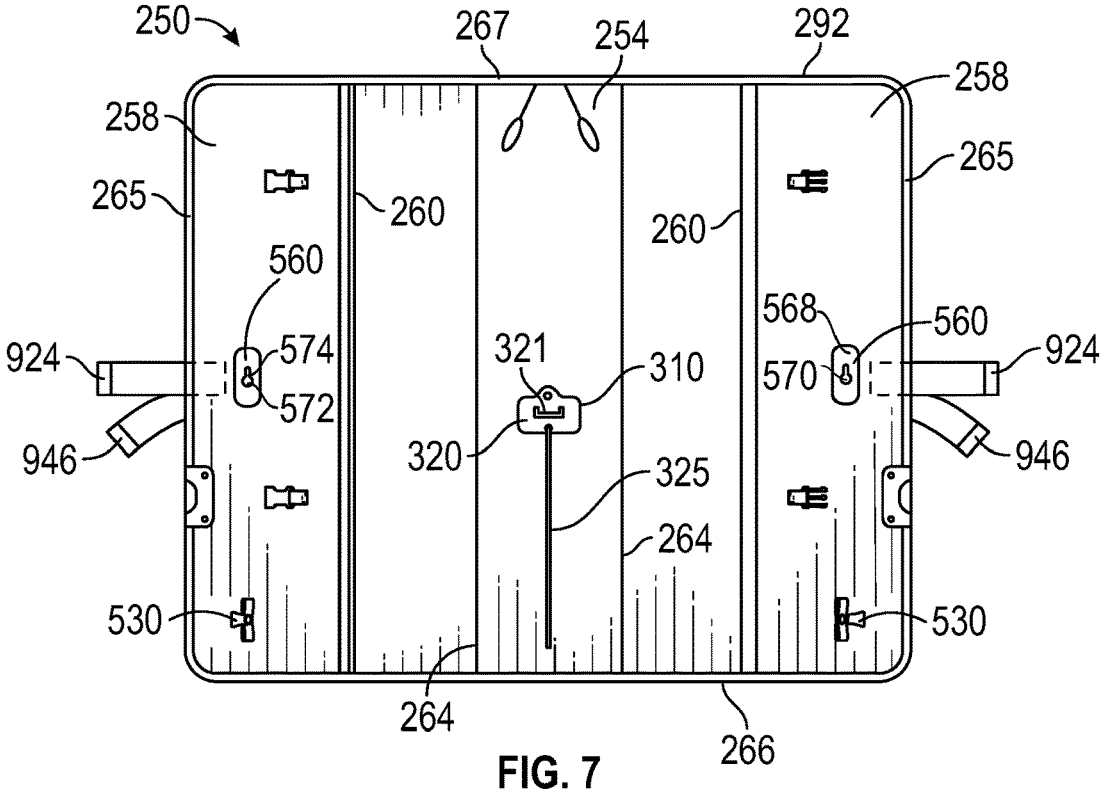
FIG. 7 is a top view of an illustrative floorboard configured for installation in a bow portion of the kayak of FIG. 2.

FIG. 7 is a top view of an illustrative bow floorboard 250 in accordance with aspects of the present teachings. Bow floorboard 250 has a medial portion 254 and a pair of lateral portions 258 each hingedly connected to a respective side of medial portion 254 at a lateral fold line 260. For illustrative purposes, FIG. 7 depicts lateral portions 258 in a position substantially coplanar with medial portion 254, but the lateral portions are generally angled relative to the medial portion when the floorboard is in use in the assembled kayak.

Bow floorboard 250 is configured to be installed in a bow region 262 of cockpit 140 (see FIG. 2), and is generally shaped to at least partially conform to the shape of cockpit floor 152 in the bow region. To achieve conformation with cockpit floor 152, medial portion 254 includes two fold lines 264 extending longitudinally along the medial portion and subdividing the medial portion into a plurality of longitudinally extending regions (three such regions, in the depicted embodiment). In the example depicted in FIG. 7, fold lines 264 are substantially parallel to each other, to lateral fold lines 260, and to lateral-portion edges 265. Other examples, however, may include any suitable number, shape, and arrangement of fold lines in the medial portion of the bow floorboard.

Lateral portions 258 and medial portion 254 are substantially rectangular in the example depicted in FIG. 7. Accordingly, bow floorboard 250 has substantially the same width at a fore end 266 and at an aft end 267. In other examples, the medial portions, lateral portions, and/or floorboard may have a different suitable shape (e.g., triangular, tapered, rhomboid, trapezoid, etc.).

Bow floorboard 250 may comprise any material suitable for supporting one or more kayak occupants, providing structure to the kayak cockpit, and/or folding along the fold lines described above. In some examples, bow floorboard 250 comprises a corrugated sheet of a suitable thermoplastic polymer, such as a heavy-duty corrugated polypropylene. In some examples, bow floorboard 250 has a thickness in the range of 5 millimeters (mm) to 15 mm, 8 mm to 10 mm, and/or any other suitable thickness.

Figure 8:
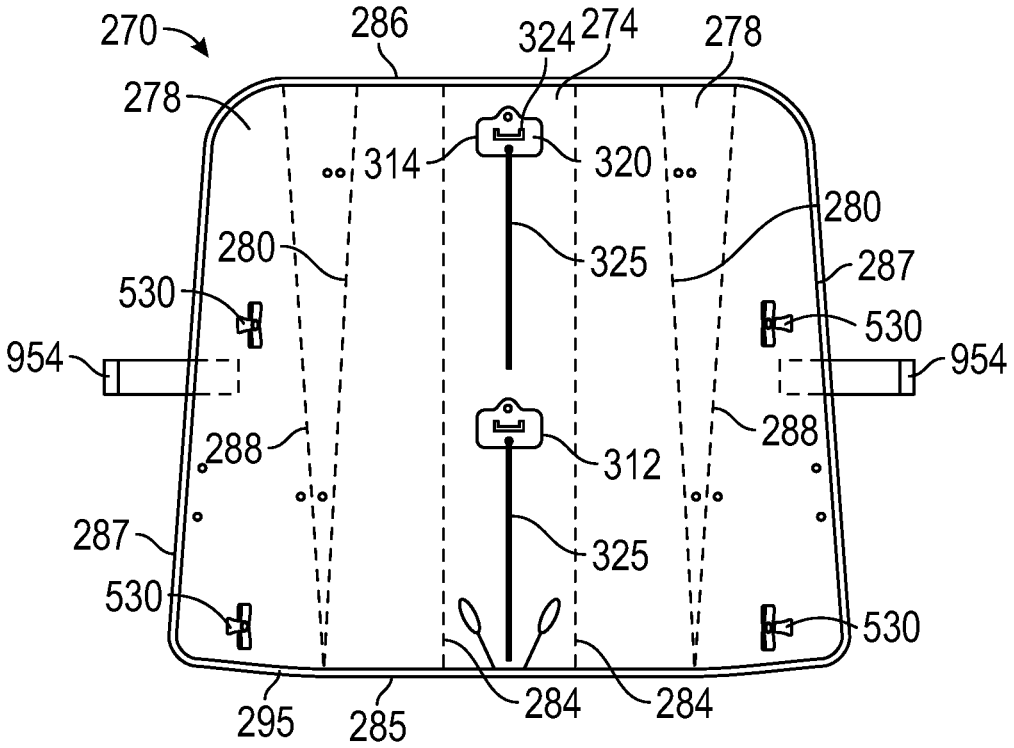
FIG. 8 is a top view of another illustrative floorboard configured for installation in a stern portion of the kayak of FIG. 2.

FIG. 8 is a top view of an illustrative stern floorboard 270 in accordance with aspects of the present teachings. Stern floorboard 270 may comprise a similar material and/or a similar thickness to that of bow floorboard 250. Stern floorboard 270 has a medial portion 274 and a pair of lateral portions 278 each hingedly connected to a respective side of medial portion 274 at a lateral fold line 280. As described above with reference to bow floorboard 250, FIG. 8 depicts lateral portions 278 in a position substantially coplanar with medial portion 274, but the lateral portions are generally angled relative to the medial portion when the floorboard is in use in the assembled kayak.

Stern floorboard 270 is configured to be installed in a stern region 282 of cockpit 140 (see FIG. 2), and is generally shaped to at least partially conform to the shape of cockpit floor 152 in the stern region. To conform to cockpit floor 152, medial portion 274 includes two fold lines 284 extending longitudinally along the medial portion and subdividing the medial portion into longitudinally extending regions. In the example depicted in FIG. 8, fold lines 284 are substantially parallel to each other, and lateral fold lines 280 are angled relative to fold lines 284, but other examples may include any suitable number and arrangement of fold lines in the medial portion of the stern floorboard. Stern floorboard 270 has a tapered shape, being wider at a fore end 285 than an aft end 286. In other words, opposing lateral portion edges 287 are angled toward each other in the aft direction. Medial portion 274 has a trapezoidal shape, being wider at a fore end than at an aft end. In other examples, however, the medial portion and/or the floorboard itself may take a different shape (e.g., to conform to a differently shaped cockpit or region of the cockpit). Lateral portions 278 each include an angled fold line 288 subdividing the respective lateral portion into two tapered regions, but in other examples, the lateral portions may have any other suitable number or arrangement of fold lines.

Bow floorboard 250 may have an edge fitting 292 extending along some or all of a perimeter of the bow floorboard. Similarly, stern floorboard 270 may have an edge fitting 295 extending along some or all of a perimeter of the stern floorboard. Edge fittings 292 and 295, which may be substantially similar, may help to protect the floorboards and to facilitate a snug fit of the floorboard edges into engagement profiles, as described further below.

As described above and shown in FIGS. 7-8, bow floorboard 250 and stern floorboard 270 have different shapes. The different shapes allow each floorboard to conform to an appropriate degree to the region of cockpit 140 in which the floorboard is typically installed. Additionally, or alternatively, the shape of each floorboard may be selected based on the position(s) on the floorboard where occupant(s) typically sit (e.g., at a fore region or an aft region of the floorboard). In some cases, the bow floorboard and the floorboard may have the same shape. Bow floorboard 250 includes a first seat receptacle 310 disposed at or near a longitudinally central area of medial portion 254. Stern floorboard 270 includes a second seat receptacle 312 disposed at or near a longitudinally central area of medial portion 274, and a third seat receptacle 314 disposed at or near an aft area of the medial portion.

In the example depicted in FIGS. 7-8, seat receptacles 310, 312, and 314 are substantially identical. Each seat receptacle 310, 312, 314 comprises a respective plate 320 attached to the associated floorboard (e.g., by one or more screws, bolts, stitches, staples, nails, adhesives, and/or any other suitable fastener(s)). Plate 320 has a slot 321 configured to receive a complementary attachment portion 323 (e.g., a tab or hook) of a seat (see FIG. 25 and the accompanying description below for an example). Attachment portion 323 is configured to clip into slot 321 to be retained in plate 320.

Bow and stern floorboards 250 and 270 include elastic cords 325 (e.g., shock cords) extending longitudinally along a portion of the floorboard in front of (e.g., forward of) each seat receptacle 310, 312, and 314. Elastic cords 325 are attached nonreleasably to the associated floorboard and/or to the associated seat receptacle, and are configured to retain a cushion or other seating surface against the floorboard (see, e.g., FIG. 18 and associated description below). In the example described herein, an elastic cord is provided for each seat receptacle, but in other examples, there may be more elastic cords than seat receptacles, or vice versa. However, as described further below, the kayak is in some configurations used with some of the seat receptacles and/or elastic cords empty. That is, the kayak may be used without installing a seat and/or seat cushion at every available receptacle and/or elastic cord. Typical seating configurations are discussed below in Section B.

Figure 9:
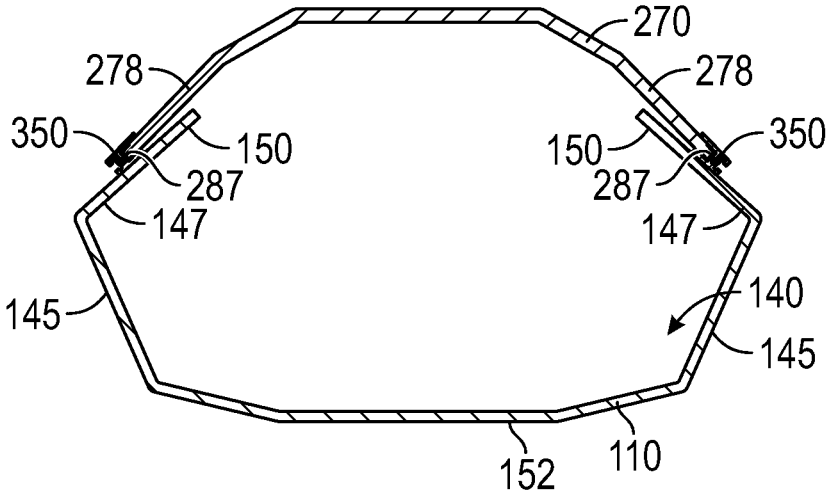
FIG. 9 is a sectional view depicting the stern floorboard of FIG. 8 partially installed in the kayak.
Figure 10:
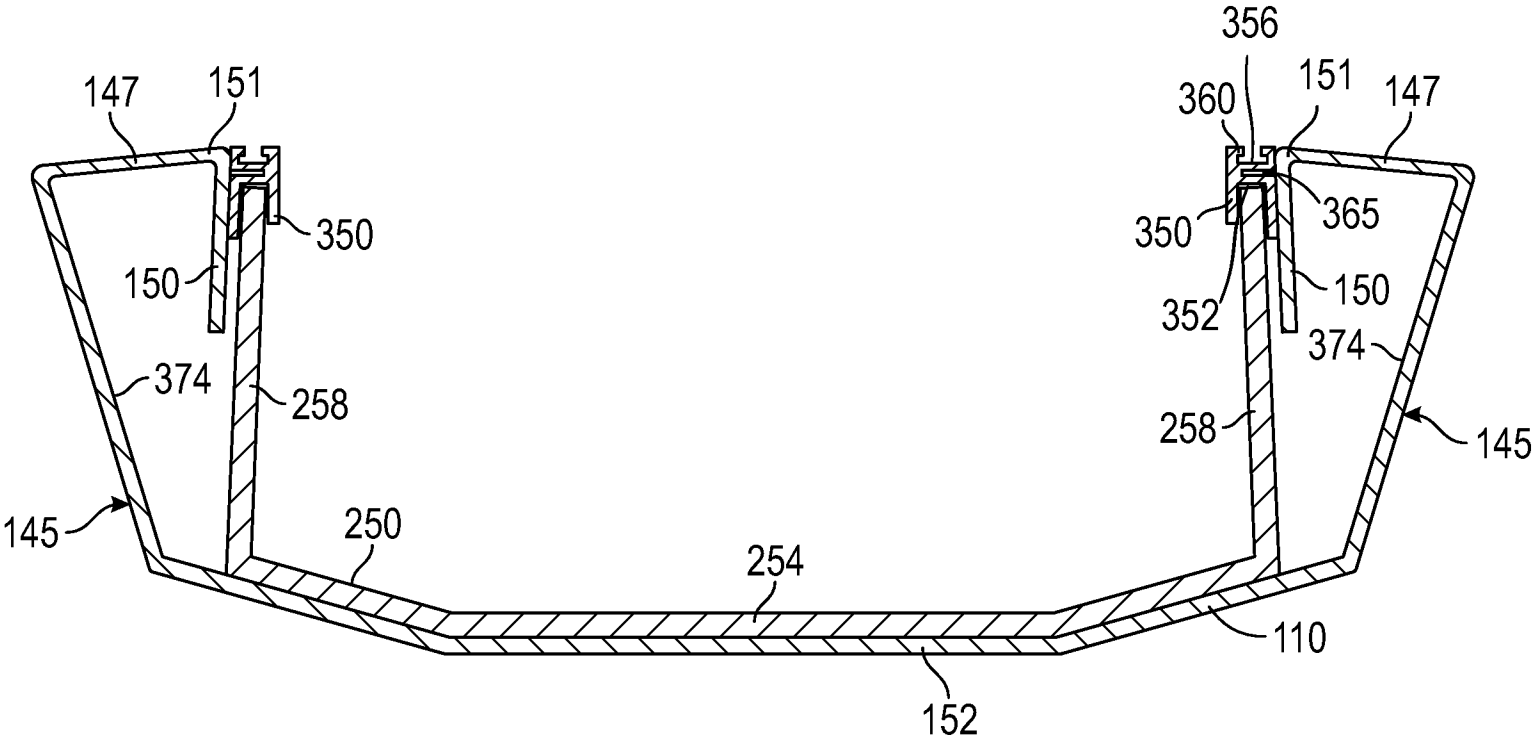
FIG. 10 is a sectional view depicting the bow floorboard of FIG. 7 secured in the kayak by illustrative engagement profiles, in accordance with aspects of the present teachings.

FIGS. 9-10 depict an illustrative attachment mechanism for attaching the floorboards to foldable sheet 110. FIG. 9 is a longitudinal sectional view depicting stern floorboard 270 partially installed in cockpit 140. To attach stern floorboard 270 to foldable sheet 110 of kayak 100, edges 287 of lateral portions 278 of the stern floorboard are each attached to one or more respective midship engagement profiles 350. Midship engagement profile 350 described here is a first example of an engagement profile; additional examples are described below.

Midship engagement profiles 350 each comprise a longitudinally extending extrusion profile comprising plastic, metal, polymer, and/or any other suitable rigid or semirigid material. Each midship engagement profile 350 is fixed nonreleasably to midship cockpit flap 150 by screws, bolts, nails, staples, stitches, adhesives, and/or any other suitable fasteners. In the example depicted in FIGS. 9-10, each midship engagement profile 350 is attached to midship cockpit flap 150 adjacent fold line 151 separating the cockpit flap from gunwale panel 147, but in other examples, the engagement profiles may be disposed at any other suitable location.

Each midship engagement profile 350 has a longitudinally extending channel 352 configured to receive one of lateral-portion edges 287. In the depicted embodiment, channel 352 is substantially rectangular in shape, but more generally engagement profile channels can have any shape configured to receive and secure a lateral-portion edge of a complementary component of the kayak. Engagement profile 350 further includes a longitudinally extending groove 356. Opposing rims 360 extend partially across groove 356 to optionally attach one or more accessories to the kayak, as described further below with reference to FIGS. 14-16. Engagement profile 350 is fastened to the cockpit flap by one or more fasteners 365.

As described above, midship engagement profiles 350 are attached to midship cockpit flaps 150. Similarly, a respective rear engagement profile 366 is attached to each rear cockpit flap 166, and a respective front engagement profile 370 is attached to each front cockpit flap 176 (see FIG. 16). Rear and front engagement profiles 366 and 370 are substantially similar to midship engagement profiles 350, but may have a different length suited to the shorter length of the rear and front cockpit flaps relative to the midship cockpit flaps. A plurality of separate rear, midship, and front engagement profiles enables foldable skin 110 to fold into the stowed configuration, by avoiding the extension of a rigid or unfoldable structure too far along the length of the kayak.

As shown in FIG. 9, installing stern floorboard 270 in kayak 100 typically includes positioning the floorboard concave down over cockpit 140 and inserting lateral portion edges 287 into channel 352 of the corresponding midship engagement profile with cockpit flaps 150 angled substantially away from cockpit floor 152. With edges 287 received in channels 352, medial portion 274 may be pushed downward to invert stern floorboard 270 such that the floorboard is concave-up within cockpit 140, and cockpit flaps 150 each point down toward cockpit floor 152, as depicted in FIG. 10. Bow floorboard 250 is typically installed in substantially the same manner as stern floorboard 270.

In some cases, the bow and stern floorboards are both inserted into the respective engagement members in the concave-down position prior to pushing either floorboard into the concave-up position, and the two floorboards are pushed down into the concave-up position substantially simultaneously. This prevents the engagement members and cockpit flaps from bending longitudinally to accommodate one concave-up floorboard and one concave-down floorboard. However, the floorboards may be installed in any suitable order or manner. Decals including graphics, indicia, and/or instructions may be printed on the floorboards to assist a user in determining the proper position and/or orientation of the floorboards in the cockpit.

FIG. 10 depicts bow floorboard 250 attached to midship engagement profiles 350. In the configuration depicted in FIG. 10, the floorboard is ready to receive a seat, or optionally, to be deployed without a seat. As FIG. 10 shows, with bow floorboard 250 installed in cockpit 150, a respective tubular beam 374 is defined by each lateral portion 258, gunwale panel 147, and outer panel 145. Similarly, a portion of each tubular beam 374 is defined between lateral portions 278 of stern floorboard 270, gunwale panel 147, and outer panel 145. Tubular beams 374 be further be defined by cockpit flaps 151 and portions of cockpit floor 152. Tubular beams 374 provide stability to the assembled kayak. For example, they tend to resist torsion of the kayak when the kayak experiences a rotational force.

Figure 11:
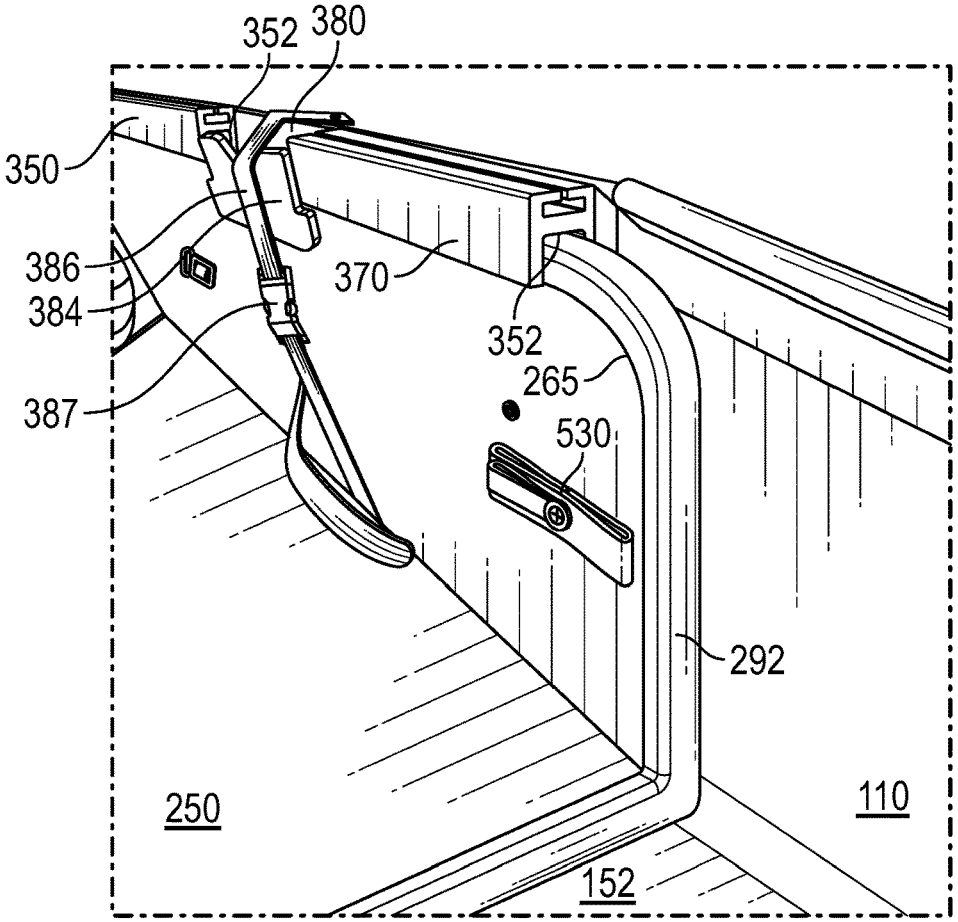
FIG. 11 is an isometric view depicting the bow floorboard of FIG. 7 retained by engagement profiles.

FIG. 11 is an isometric view of bow floorboard 250 received within channel 352 of front engagement profile 370 and channel 352 of midship engagement profile 350. As shown in FIG. 11, with the kayak in the assembled configuration, front engagement profile 370 is spaced from midship engagement profile 350 by a gap 380. Bow floorboard 250 includes a respective mating plate 384 attached to each lateral-portion edge 265 and configured to sit between front engagement profile 370 and midship engagement profile 350 when the floorboard is installed within the cockpit. Aligning mating plates 384 with gaps 380 helps a user to position the floorboard correctly. Additionally, or alternatively, the mating plates may help prevent the floorboard from sliding longitudinally within the engagement profiles.

Straps 386 attached to foldable sheet 110 are configured to pass over mating plates 384 to be releasably coupled to respective buckles 387 attached to floorboard lateral portions 258, further helping to secure the floorboard in place. Other ones of straps 386, disposed at other longitudinal positions along the kayak, pass over the engagement profiles rather than the mating plates to releasably couple to buckles attached to the floorboard. Specific straps 386a-386h are indicated in FIG. 3 for reference.

Figure 18:
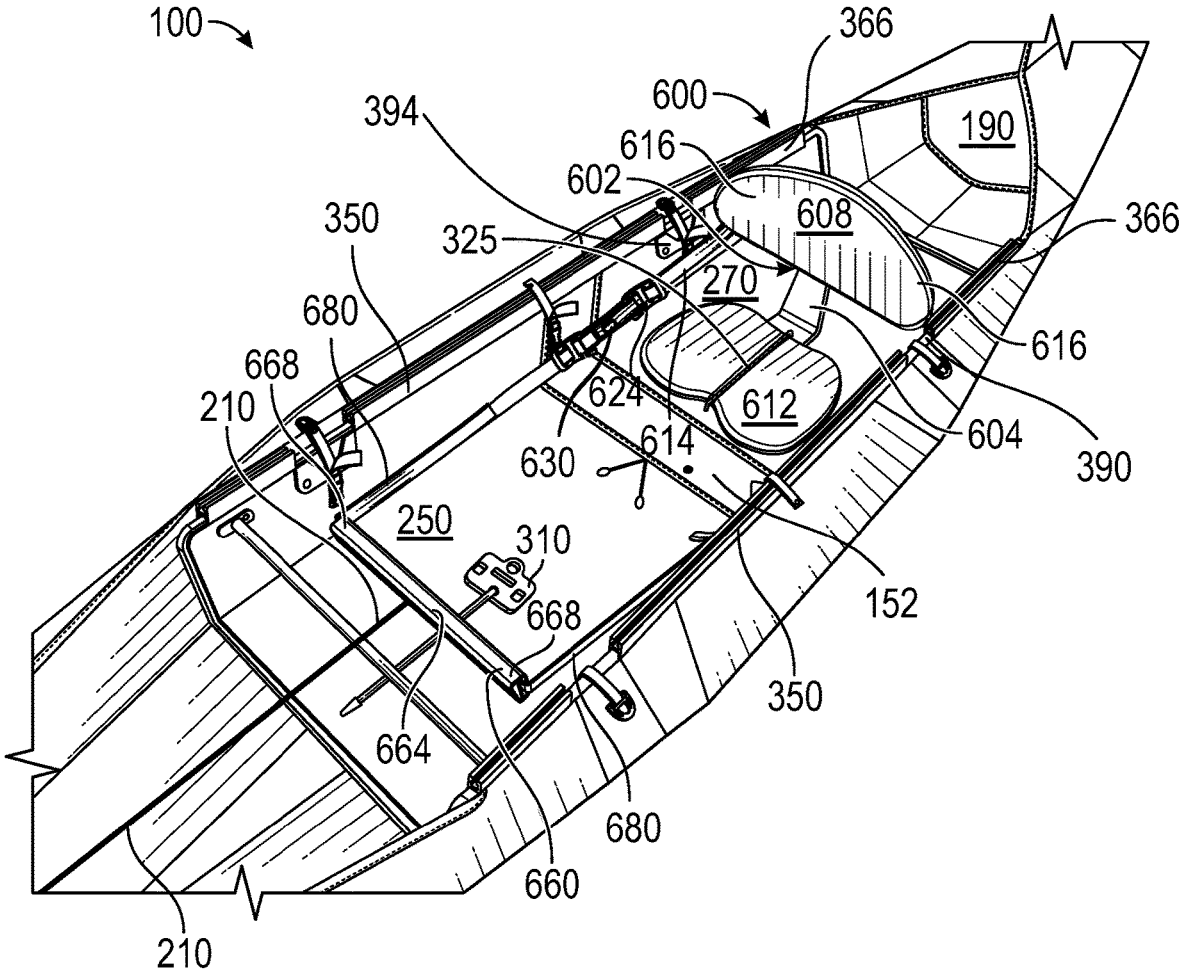
FIG. 18 is an isometric view depicting the kayak of FIG. 2 assembled in an illustrative single-seat configuration, in accordance with aspects of the present teachings.

Similarly, rear engagement profile 366 is spaced from midship engagement profile 350 by a gap 390, and stern floorboard 270 includes an opposing pair of mating plates 394 configured to fit within gaps 390—see FIG. 18.

Figure 12:
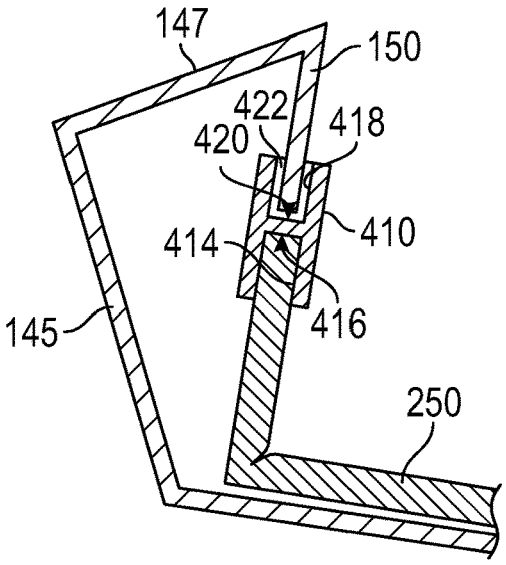
FIG. 12 is a partial sectional view depicting the bow floorboard of FIG. 7 secured in the kayak by another illustrative engagement profile, in accordance with aspects of the present teachings.
Figure 13:
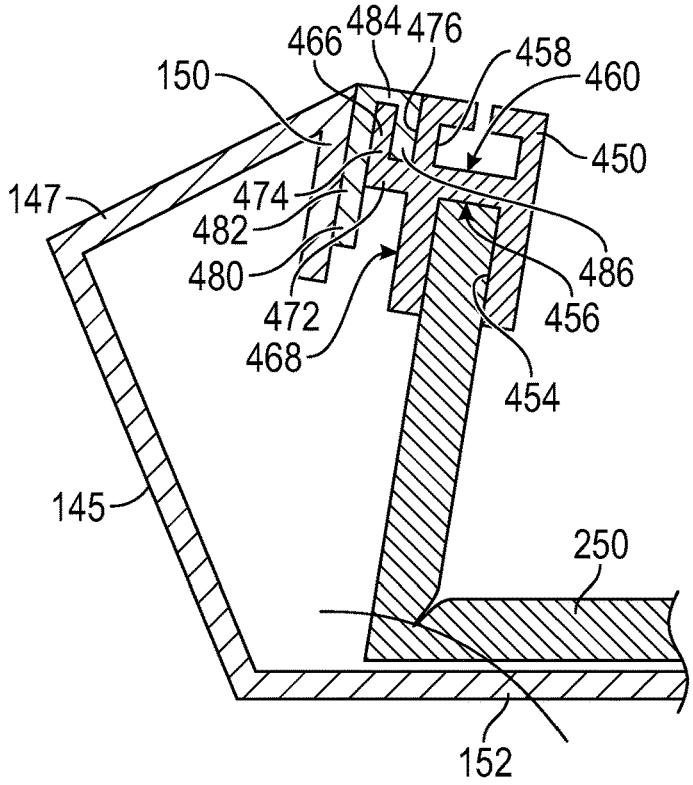
FIG. 13 is a partial sectional view depicting the bow floorboard of FIG. 7 secured in the kayak by yet another illustrative engagement profile, in accordance with aspects of the present teachings.

FIGS. 12-13 depict alternative illustrative examples of an engagement profile in accordance with aspects of the present teachings. FIG. 12 is a sectional view depicting a second engagement profile 410. Engagement profile 410 has a first longitudinal channel 414 formed in a first surface 416, and a second longitudinal channel 418 formed in a second surface 420 opposite the first surface. First longitudinal channel 414 is configured to nonreleasably receive an edge of a lateral portion of a floorboard. For example, the floorboard may be attached to the interior of the channel with an adhesive, may be fastened to the channel by screws or other suitable fasteners, and so on. Second longitudinal channel 418 is configured to releasably receive the edge of the cockpit flap. An edge covering 422 may be attached to the edge of the cockpit flap to facilitate snug reception of the cockpit flap in second longitudinal channel 418. In some examples, however, the edge of the cockpit flap is received nonreleasably in the second longitudinal channel, and the edge of the floorboard is received releasably in the first longitudinal channel.

FIG. 13 is a sectional view depicting a third engagement profile 450. Engagement profile 450 has a longitudinal channel 454 formed in a first surface 456 and a groove 458 formed in a second surface 460 opposite the first surface. Groove 458 may be substantially similar in at least some respects to groove 356 of engagement profile 350, described above. For example, groove 458 typically has a narrow opening formed by opposing rim portions extending partially over a wider main groove portion. A floorboard edge is secured nonreleasably in longitudinal channel 454.

Engagement profile 450 further includes a hook 466 extending from a third surface 468. Hook 466 comprises a stem portion 472 protruding substantially orthogonally from third surface 468 and a lip portion 474 extending from the stem portion in a directional substantially coplanar with the third surface. Accordingly, a slot 476 is defined between lip portion 474 and third surface 468. A complementary cockpit hook 480 is attached to the cockpit flap and configured to releasably couple to hook 466. For example, cockpit hook 480 may include a first hook surface 482 attached nonreleasably to the cockpit flap, a stem portion 484 protruding substantially orthogonally to the first hook surface, and a lip portion 486 extending from the stem portion in a direction substantially coplanar with the first hook surface. Lip portion 486 of cockpit hook 480 is configured to be received snugly within slot 476 defined between lip portion 474 and third surface 468 of engagement profile 450, thereby releasably coupling the floorboard to the cockpit flap. In other examples, lip portion 486 of cockpit hook 480 may be nonreleasably secured within slot 476, and longitudinal channel 454 may be configured to releasably receive the floorboard edge.

Figure 14:
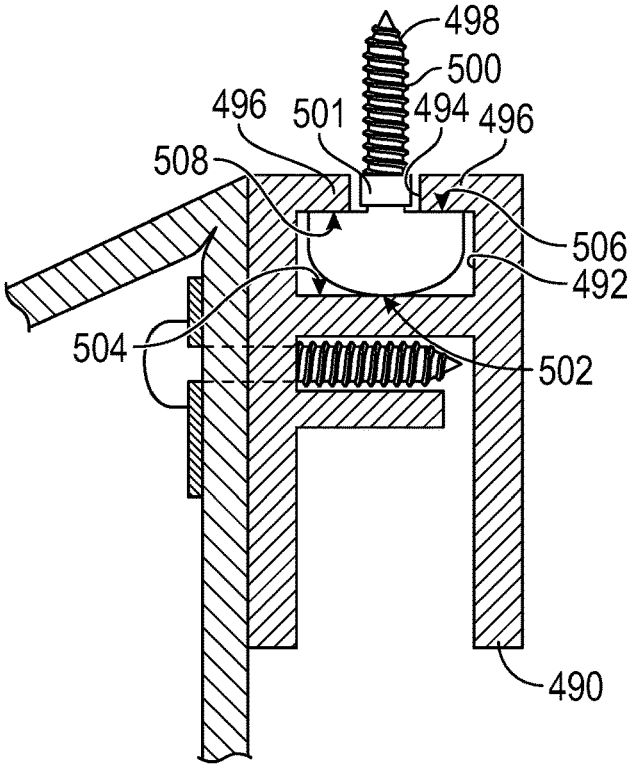
FIG. 14 is a partial sectional view depicting yet another illustrative engagement profile and a bolt for retaining an accessory (not shown) within a groove of the engagement profile, in accordance with aspects of the present teachings.

FIG. 14 depicts a fourth illustrative engagement profile 490. Engagement profile 490 is substantially similar in some respects to engagement profile 350. For example, profile 490 includes a groove 492 having a relatively narrow opening 494 defined by opposing lip portions 496. A bolt 498 is positioned within the groove, with shaft 500 of the bolt protruding from opening 494 and neck 501 of the bolt disposed between lip portions 496. Typically, neck 501 is a square neck sized to fit between lip portions 496 in sliding engagement, which tends to increase the stability of the bolt within the groove compared to other neck shapes. Bolt 498 has a first surface 502 configured to be in sliding engagement with a bottom surface 504 of groove 492, and a second surface 506 configured to be in sliding engagement with undersides 508 of lip portions 496. An accessory 510 may be threadedly attached to bolt 498 (see FIG. 15), such that the bolt supports the accessory on profile 490 and attaches the accessory to the kayak. Depending on how tightly the accessory is screwed on to shaft 500, the accessory and bolt may be slidable along profile 490, or may be fixed in a selected longitudinal position along the profile.

Figure 15:
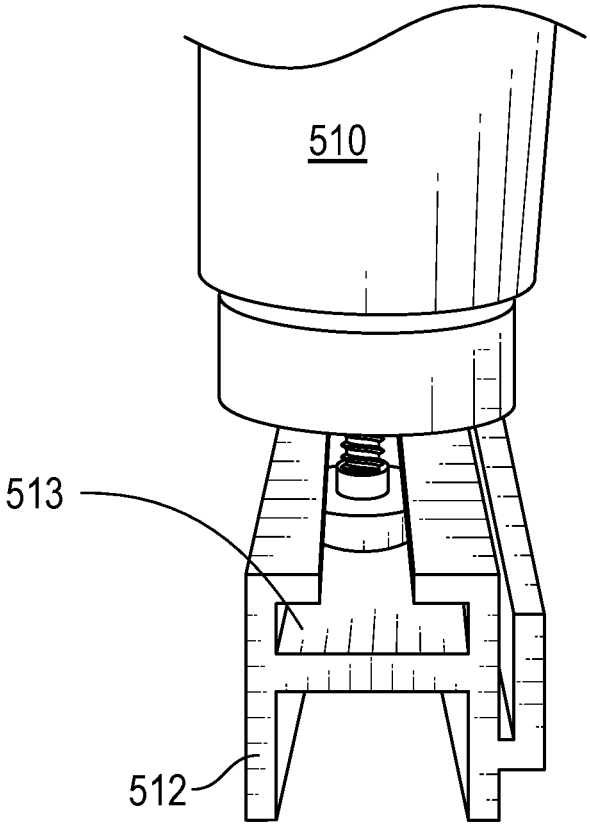
FIG. 15 is an isometric view depicting an illustrative accessory retained within a groove of yet another illustrative engagement profile, in accordance with aspects of the present teachings.

FIG. 15 is an isometric view depicting accessory 510 attached to yet another illustrative engagement profile 512. Profile 512 has a groove 513 that is substantially similar to groove 492. Exemplary accessories suitable for attachment in groove 512, groove 492, groove 458, groove 356, and the like may include, without limitation: photography equipment (e.g., cameras), fishing equipment (e.g., fishing rods), hunting equipment (e.g., firearms, binoculars, etc.), holders for one or more kayak paddles, baskets or other containers, and/or any other suitable accessories.

Figure 16:
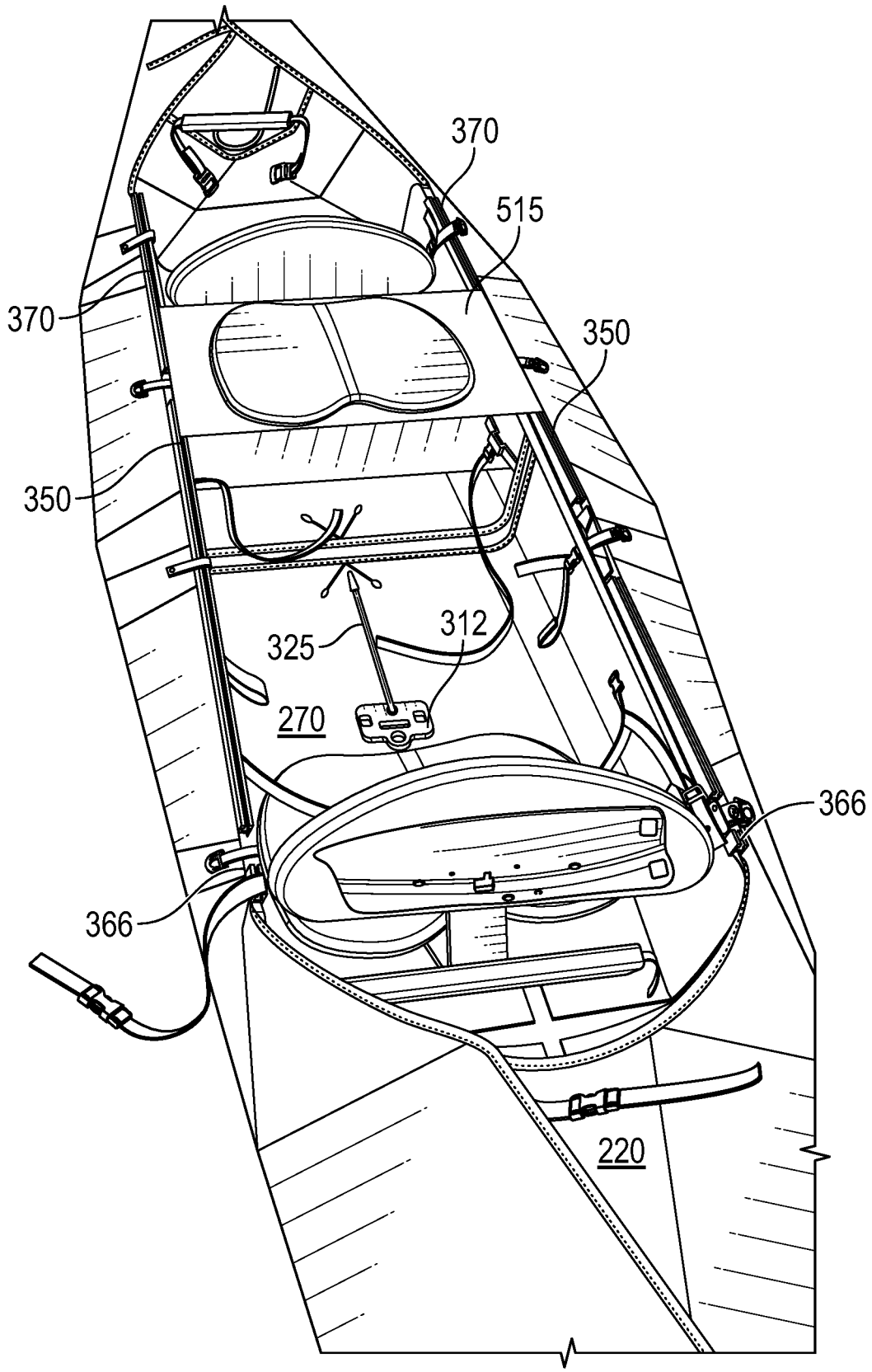
FIG. 16 is an isometric view of the kayak of FIG. 2 with an illustrative bench attached to the engagement profiles of FIG. 10.

FIG. 16, which is an isometric view, depicts an illustrative bench 515, which is another example of an accessory attachable to kayak 100 by a groove in an engagement profile (here, profile 350) attaching the floorboard(s) to the foldable sheet. Bench 515 provides a seat that is elevated above the kayak floorboards (e.g., in comparison to seats attached using seat receptacles 310, 312, and 314, and/or elastic cords 325). Due to its height above the floorboards, bench 515 may be useful for an occupant who has mobility problems, an occupant who wants to sit at a greater distance above the cockpit sides (e.g., a child who cannot see easily over the sides of the kayak, someone using a fishing rod or other device, etc.), and/or the like. Bolts disposed at a lower surface of bench 515 may be retained within groove 356 of engagement profile 350 in substantially the manner described above with reference to FIGS. 14-15.

Figure 17:
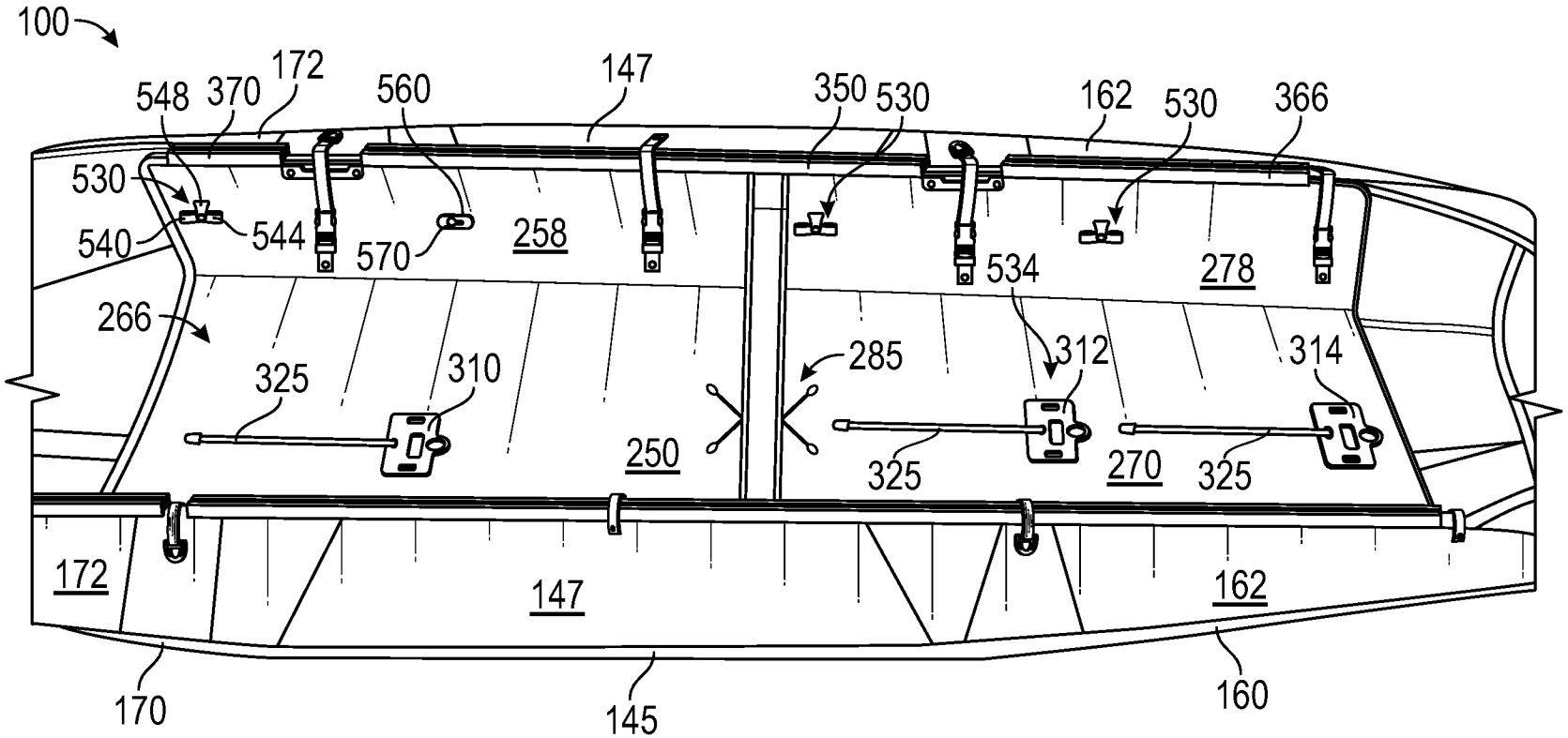
FIG. 17 is an isometric side view of a cockpit of the kayak of FIG. 2, depicting the bow and stern floorboards with no seats installed.

FIG. 17 is an isometric view from a port side of kayak 100. FIG. 17 depicts bow and stern floorboards 250 and 270 installed within the assembled kayak, with no seats or footrests installed. As FIG. 17 shows, coupling devices for attaching seats and/or footrests are attached to lateral portions 258 of bow floorboard 250 and lateral portions 278 of stern floorboard 270. For example, a respective bow-tie loop 530 is attached to each lateral portion 258 of bow floorboard 250 adjacent fore end 266 of the bow floorboard. Stern floorboard 270 includes two pairs of bow-tie loops 530. A respective bow-tie loop 530 is attached to each lateral portion 278 of stern floorboard 270 adjacent fore end 285 of the stern floorboard, and a respective bow-tie loop is attached to each lateral portion of the stern floorboard adjacent a longitudinally central portion 534 of the stern floorboard. In other examples, a different number of bow-tie loops may be provided, and/or the bow-tie loops may be disposed at different locations on the floorboard. In other examples, any other suitable strap, loop, buckle, or other attachment mechanism may be used in place of one or more of the bow-tie loops depicted here.

Each bow-tie loop 530 has a first loop 540 and a second loop 544 extending in a direction opposite the first loop. In the example depicted in FIG. 17, the bow-tie loops each comprise a single strip of durable fabric positioned in an oblong loop and fastened together at the middle, dividing the oblong loop into first and second loops 540 and 544. The fastener that divides the oblong loop also attaches bow-tie loop 530 to the lateral portion of the floorboard. This arrangement allows first and second loops 540 and 544 to be attached to the floorboard at the same point, thereby reducing the number of punctures made to the floorboard (in examples wherein the loops are attached by fasteners that penetrate the floorboard). In other examples, first and second loops 540 and 544 may comprise separate pieces of material. Optionally, one or more bow-tie loops 530 may further comprise a third loop 548.

Figure 21:
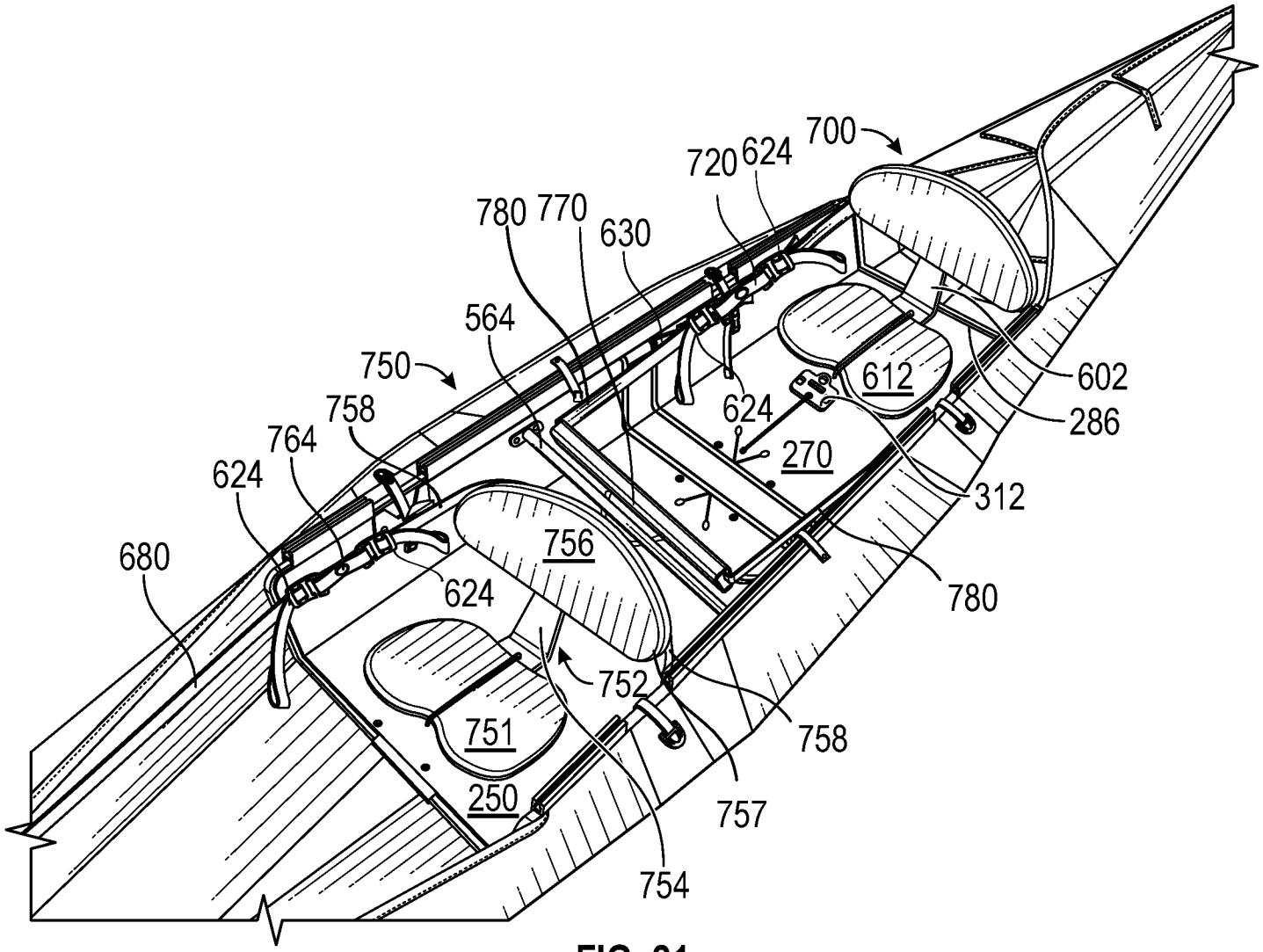
FIG. 21 is an isometric view depicting the kayak of FIG. 2 assembled in an illustrative tandem configuration, in accordance with aspects of the present teachings.

A plurality of rod attachment plates 560 are attached to the floorboard lateral portions and configured to support one or more reinforcing rods 564 (see FIG. 21). In the example depicted in FIG. 17, one pair of rod attachment plates 560 is attached to bow floorboard 250, with one rod attachment plate disposed on each lateral portion 258 of the bow floorboard. In other examples, the rod attachment plates may be disposed at a different location, and/or more than one pair of rod attachment plates may be provided, to accommodate a reinforcing rod in different positions, or to accommodate more than one reinforcing rod.

Referring back to FIG. 7, each rod attachment plate 560 comprises a plate 568 nonreleasably attached to the floorboard lateral portion. Plate 568 has a keyhole-shaped slot 570 having a wide portion 572 and a narrow portion 574. Wide portion 572 is sized and shaped such that an end of the reinforcing rod may be inserted into the wide portion (e.g., in a direction substantially transverse to a surface of plate 568). Narrow portion 574 is sized and shaped to prevent the end of the reinforcing rod from being withdrawn from the narrow portion in a direction substantially transverse to the surface of plate 568. Accordingly, the reinforcing rod may be coupled to rod attachment plate 560 by inserting the end of the rod into wide portion 572 and sliding the rod longitudinally such that the end of the rod is retained within narrow portion 574. The retaining rod may have ends and/or narrowed portions adjacent the ends, to facilitate coupling the rod to the attachment plate.

Each end of the rod may be coupled to a respective rod attachment plate 560. In this manner, the reinforcing rod provides support to midship side portions 137, 138. A kayak according to aspects of the present teachings may include any suitable number of pairs of rod attachment plates, and any suitable number of the pairs of rod attachment plates may be used as desired to support reinforcing rods. In some examples, no rod attachment plates are included. Alternatively, or additionally, one or more reinforcing rods may be configured to be attached to the kayak via grooves of the engagement profiles.

B. Illustrative Single-Seat and Tandem Configurations

With reference to FIGS. 18-23, this section describes, without limitation, exemplary optional configurations of seats and footrests removably installable in kayak 100.

FIG. 18 is an isometric view of kayak 100 assembled in a single-seat configuration. In the single-seat configuration, a first seat assembly 600 is installed in kayak 100. First seat assembly 600 includes a first seat back 602, which is installed in second seat receptacle 312 disposed adjacent central portion 534 of stern floorboard 270. Seat back 602 includes a seat column 604 coupled to a seat backrest 608. Seat backrest 608 is configured to support the back of an occupant sitting in cockpit 140. Seat column 604 is configured to support seat backrest 608 at a suitable height above cockpit floor 152. Seat column 604 is further configured to couple to second seat receptacle 312. For example, seat column 604 may include a tab configured to be received in slot 321 of second seat receptacle 312, thereby releasably securing seat back 602 to stern floorboard 270.

Seat assembly 600 further includes a first seating surface 612, which is installed in front of (e.g., forward of) seat receptacle 312, such that an occupant can sit on the seating surface and lean back against seat back 602. Seating surface 612 is retained against stern floorboard 270 by elastic cord 325. Seating surface 612 is typically installed in kayak 100 by sliding the seating surface under elastic cord 325. Seating surface 612 may comprise any cushioned or uncushioned surface suitable for supporting an occupant in a seated position.

A respective strap 614 is attached nonreleasably to each lateral side 616 of seat backrest 608. Strap 614 is coupled to a hook 624, which is configured to couple to a connector 630. Connectors 630 are a pair of bow-tie loops 530 that are disposed at lateral portions 278 of stern floorboard 270 adjacent fore end 285 of the stern floorboard.

Figure 19:
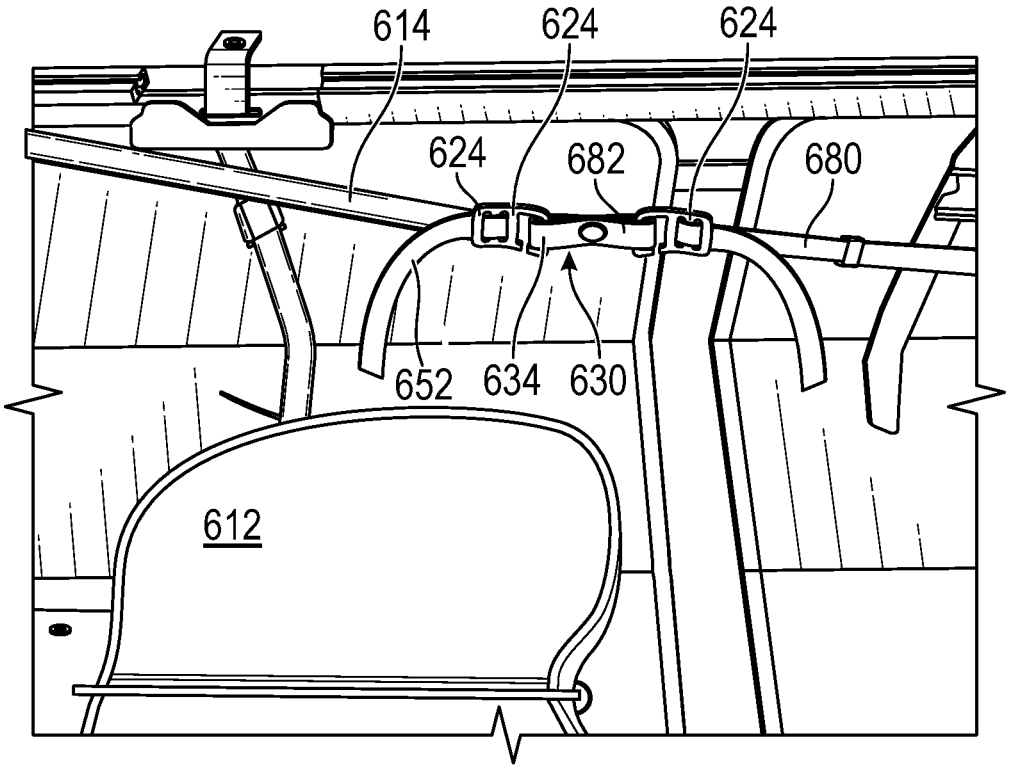
FIG. 19 is an isometric side view depicting an illustrative bow-tie loop retaining illustrative hooks attached to a footrest and a seat of the single-seat configuration of FIG. 18, in accordance with aspects of the present teachings.
Figure 20:
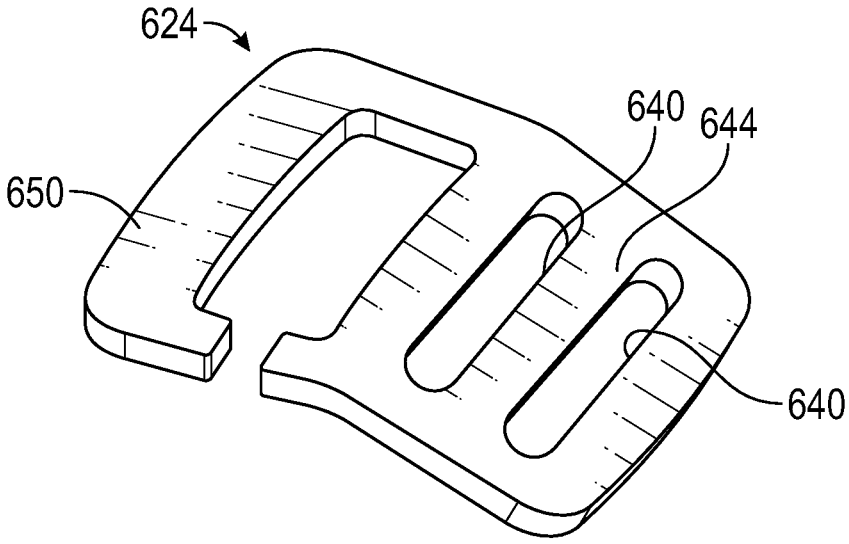
FIG. 20 is an isometric view depicting one of the hooks of FIG. 19.

FIG. 19 is an isometric view depicting hook 624 coupling strap 614 to first loop 634 of bow-tie loop 630, and FIG. 20 is an isometric view of hook 624 alone (e.g., without any straps or loops). As these views show, hook 624 has a pair of parallel slots 640 separated by a bar 644. Strap 614 passes through one of the parallel slots 640, wraps around bar 644, and passes through the other parallel slot 640. A hooked projection 650 of hook 624 engages first loop 634 of bow-tie loop 630. Straps 614 can each be tightened (e.g., by pulling a free end 652 of the strap away from the corresponding hook 624) to secure seat back 602 and/or to adjust an angle of the seat back (e.g., relative to the floorboard and/or seat column). In this manner, straps 614 retain seat backrest 608 in a desired position when an occupant is leaning back (e.g., aft) against the seat backrest.

Returning to FIG. 18, seat assembly 600 optionally includes a first footrest 660. In the single-seat configuration, footrest 660 is installed in kayak 100 to support the feet of an occupant seated on seating surface 612. Footrest 660 comprises a bar of substantially rigid material. A central portion 664 of footrest 660 is coupled nonreleasably to cable 210, which is the cable described above as passing through the bow bulkhead and being coupled nonreleasably to foldable sheet 110 at bow portion 120 (see FIG. 6).

Cable 210 is typically elastic, which allows the cable to be stretched such that footrest 660 may be installed at any of a plurality of different longitudinal positions within the kayak. In some examples, however, the cable is substantially inelastic.

Footrest 660 is coupled nonreleasably at each end 668 to a respective strap 680. In the single-seat configuration of kayak 100, straps 680 are coupled to second loops 682 of bow-tie loops 630 by a respective hook 624. Straps 680 can be tightened using the associated hook 684 such that footrest 660 is suspended by straps 680 and by cable 210. An occupant of seating surface 612 can brace their feet against footrest 660 for increased comfort and/or for leverage while paddling the kayak. By adjusting straps 680, footrest 660 may be suspended at a desired height above the floorboard, and/or at a desired longitudinal position within the kayak. For example, footrest 660 may be suspended at a height suitable for engaging a ball of the occupant's foot, and at a distance that accommodates the user's height with the user's legs bent to a desired degree (or not at all).

In some examples, footrest 660 is omitted. In examples wherein footrest 660 is included in the kayak, such as the example depicted in FIG. 18, installing and using the footrest may be optional.

FIG. 21 depicts kayak 100 in a tandem configuration, including two seat assemblies 700, 750, which will be referred to as second and third seat assemblies to distinguish them from seat assembly 600 described above with respect to the single-seat configuration. A second seat assembly 700 is installed at stern floorboard 270. Second seat assembly 700 includes first seat back 602 and first seating surface 612. In the tandem configuration, first seat back 602 is installed at third seat receptacle 314 adjacent aft end 286 of stern floorboard 270, and first seating surface 612 is installed under elastic cord 325 adjacent third seat receptacle 314. In other words, second seat assembly 700 includes the same seat back and seating surface that are usable in the single-seat configuration, but in the tandem configuration this seat back and seating surface are typically installed at a different seat receptacle than in the single-seat configuration. Specifically, they are typically installed at third seat receptacle 314 in the tandem configuration, which is aft of second seat receptacle 312, where they are installed in the single-seat configuration.

In the tandem configuration, each strap 614 is coupled to a connector 720 by a hook 624, as described above with reference to first seat assembly 600. Connectors 720 are a pair of bow-tie loops 530 disposed on lateral portions 278 of stern floorboard 270 adjacent central portion 534 of the stern floorboard.

In other examples, the seat back and seating surface of the second seat assembly may not be the same seat back and seating surface used in the single configuration, and they may or may not be identical to the seat back and seating surface used in the single configuration. However, using the same seat back and seating surface on the stern floorboard in both configurations allows a user to use either the tandem or single-seat configuration without needing three separate seat assemblies, which reduces the cost of the kayak and the amount of space needed to store the kayak.

In the tandem configuration, a third seat assembly 750 is installed at first seat receptacle 310 on bow floorboard 250. Third seat assembly 750 includes a second seating surface 751, which may be substantially similar to first seating surface 612 in at least some respects. Second seating surface 751 is retained against bow floorboard 250 by elastic cord 325 disposed adjacent first seat receptacle 310.

In some cases, one of seat assemblies 700, 750 may be installed at the same seat receptacle used in the single-seat configuration. For example, two seat receptacles may be provided rather than three, with the single-seat configuration using one of the seat receptacles and the tandem configuration using both of the seat receptacles.

Third seat assembly 750 further includes a second seat back 752 including a seat column 754 and a seat backrest 756. Second seat back 752 is substantially similar to first seat back 602 in at least some respects. For example, each lateral side 757 of second seat back 752 is attached nonreleasably to a respective strap 758. Each strap 758 is coupled by a hook 624 to a connector 764, which is an example of bow-tie loop 530. Bow-tie loops 764 are a pair of bow-tie loops disposed at lateral portions 258 of bow floorboard 250 adjacent a fore end 266 of the bow floorboard.

Second seat back 752 is coupled to a second footrest 770. Second footrest 770 comprises a bar of substantially rigid material coupled nonreleasably to a pair of straps 780. In the assembled tandem configuration, straps 780 are coupled to connectors 720 by hooks 624, as described above with reference to first footrest 660.

Figure 22:
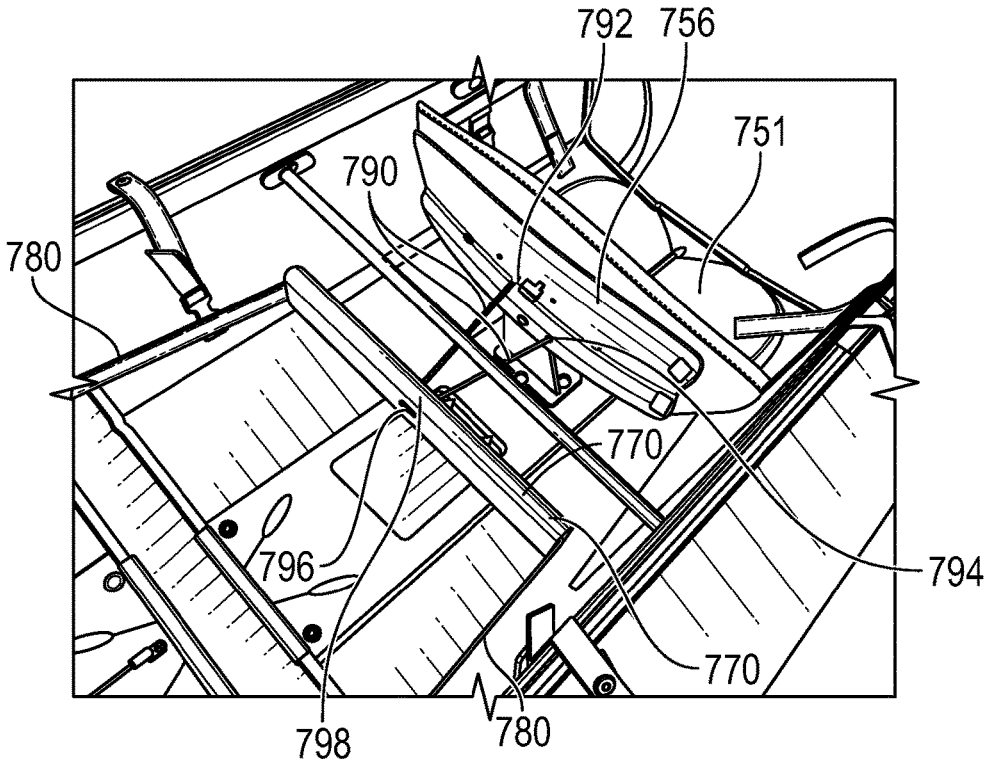
FIG. 22 is an isometric view depicting an illustrative connection between one of the footrests and one of the seats of the tandem configuration of FIG. 21.

The second footrest may be coupled to the seat back of the third seat assembly by any suitable mechanism. FIG. 22 is an isometric view depicting the second footrest and third seat assembly. In the example depicted in FIG. 22, second footrest 770 is coupled nonreleasably to seat backrest 756 by a cable 790. First and second ends 792 and 794 of cable 790 are attached nonreleasably to backrest 756, and a central portion 796 of the cable is attached nonreleasably to a central portion 798 of second footrest 770. Cable 790 may be elastic or substantially inelastic. Straps 780, which as described above are attached to ends 778 of second footrest 770 and coupled to second loops 784, may be tightened to suspend the second footrest at a desired tension from straps 780 and cable 790. In this manner, second footrest 770 is configured to support the feet of an occupant of second seat assembly 700. Second footrest 770 may also help to stabilize seat backrest 756 by providing a tension force on the backrest.

Figure 23:
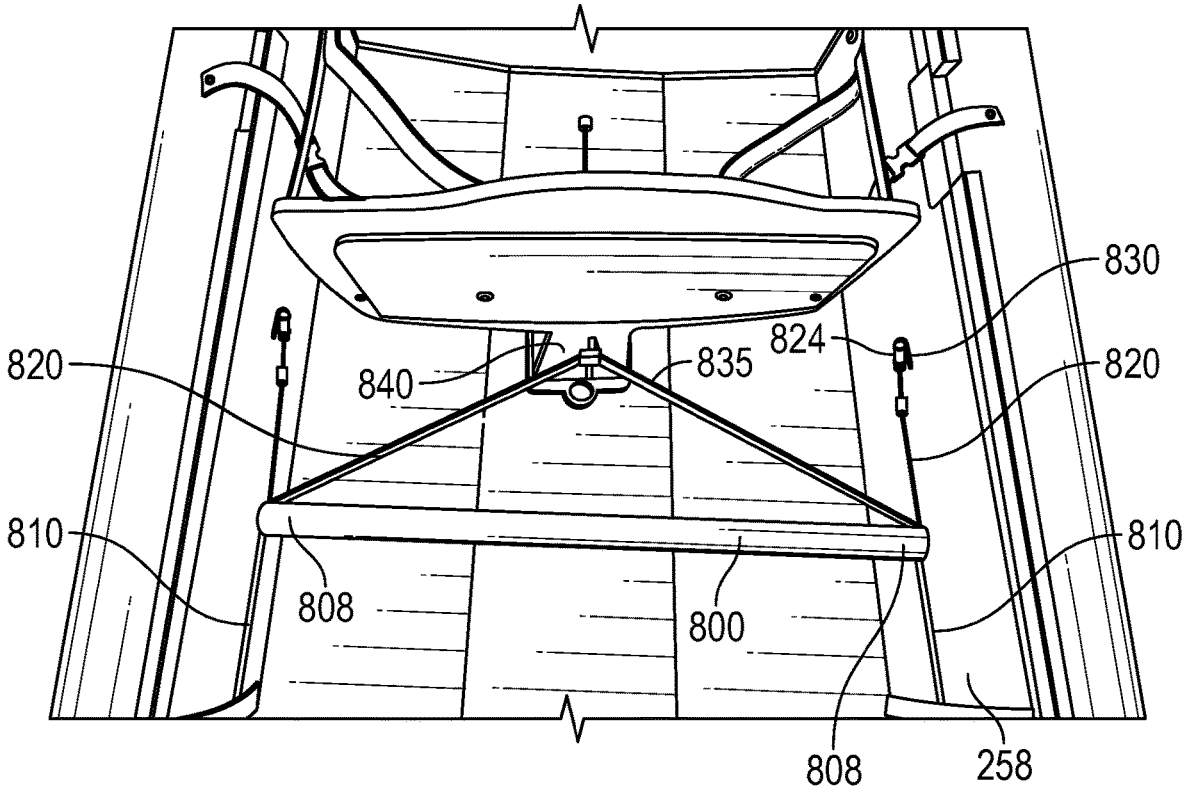
FIG. 23 is an isometric view depicting another illustrative connection between the footrest and seat of FIG. 22.

FIG. 23 depicts a floorboard-coupled footrest 800, which is another example of a footrest coupled to the seat back of the third seat assembly and configured to be used by an occupant of second seat assembly 700. Floorboard-coupled footrest 800 may be substantially similar to second footrest 770 in at least some respects. For example, each end 808 of floorboard-coupled footrest 800 is attached nonreleasably to a strap 810, which can be coupled to connectors 720 in the manner depicted in FIG. 21. Footrest ends 808 are each coupled to a cable 820. Ends of cable 820 are attached nonreleasably to a pair of cable hooks 824, which may have any suitable form. In a tandem configuration including floorboard-coupled footrest 800, cable hooks 824 are coupled to a pair of attachment loops 830 disposed on lateral portions 258 of bow floorboard 250. Attachment loops 830 may take any form suitable for selectively connecting to cable hooks 824.

A central portion 835 of cable 820 is attached to a seat column 840 of the third seat assembly. Seat column 840 is another example of a seat column of a seat back suitable for use in third assembly 750. Seat column 840 may be substantially similar to seat column 754 in at least some respects, and is further configured to be nonreleasably attached to central portion 835 of cable 820.

As described above, floorboard-coupled footrest 800 and second footrest 770 are coupled nonreleasably to the seat back of third seat assembly 750. In other examples, the footrest may instead be attached releasably to the seat back (e.g., to the backrest, seat column, and/or any other suitable part of the seat assembly). However, a footrest attached nonreleasably to the seat back may simplify assembly of the kayak by reducing or preventing user confusion as to where in the kayak the footrest should be installed. A nonreleasable attachment also reduces the risk that the footrest will be lost.

Returning to FIG. 21, an occupant of third seat assembly 750 may optionally use first footrest 660, which as described above is coupled nonreleasably to foldable sheet 110 at bow portion 120. Footrest 660 is out of view in FIG. 21, but one of straps 680 coupled nonreleasably to footrest 660 is shown. Straps 680 are coupled by hooks 624 to a second loop connector 764.

As shown in FIG. 21 and FIG. 18, footrest 660 is typically positioned further forward in the tandem configuration (FIG. 21) than in the single-seat configuration (FIG.

18). This is because first seat assembly 600 is typically positioned further forward in the single-seat configuration than is third seat assembly 750 in the tandem configuration. Straps 680 and cable 210, which as described above attaches footrest 660 to foldable sheet 110, each have respective lengths sufficiently long to accommodate both configurations. Cable 210 may be configured to stretch by different amounts to accommodate the desired configuration.

Figure 24:
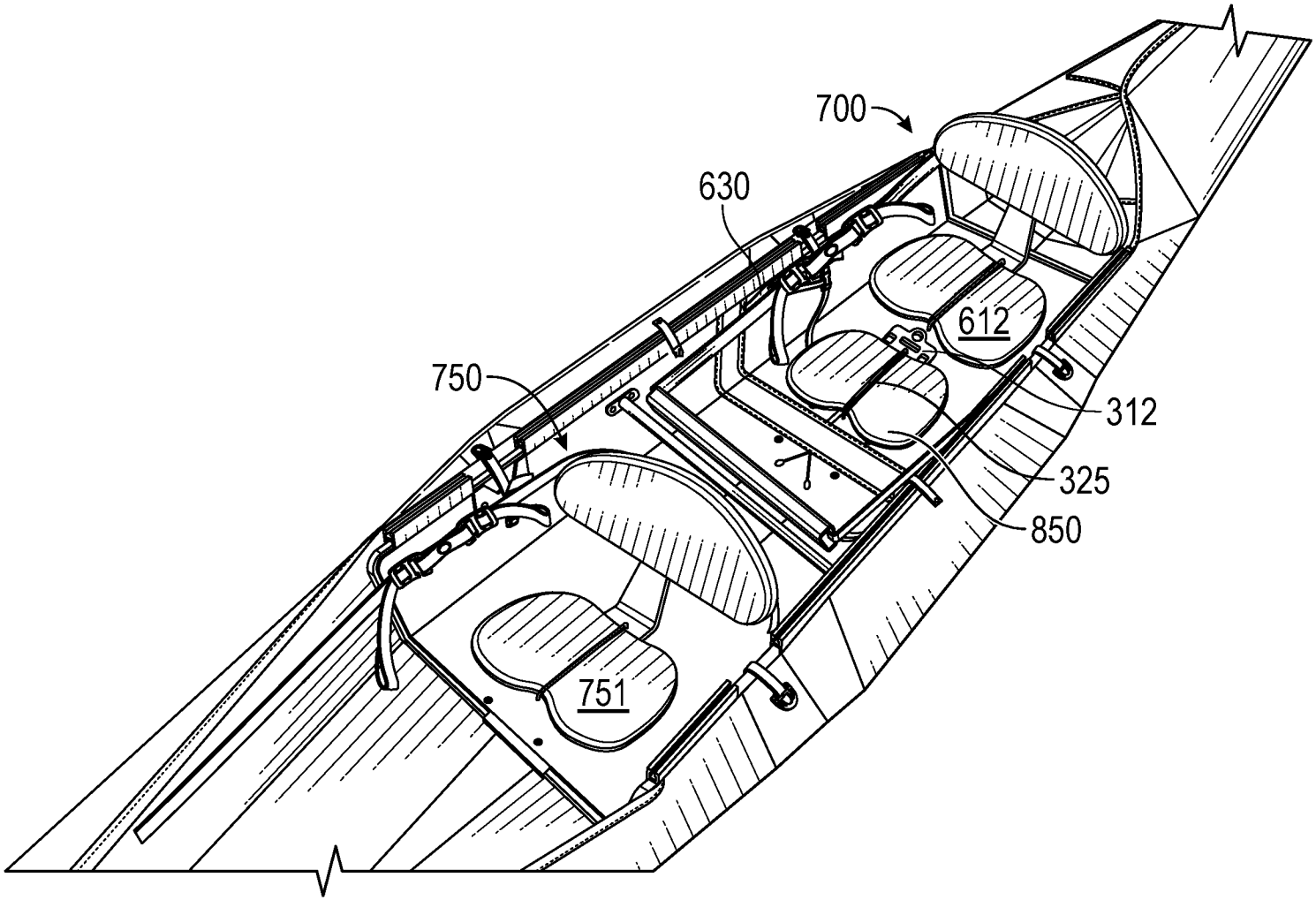
FIG. 24 is an isometric view depicting the kayak of FIG. 2 in the tandem configuration with an additional seating surface installed, in accordance with aspects of the present teachings.

FIG. 24 is an isometric view depicting kayak 100 in the tandem configuration with an additional seating surface 850 installed at elastic cord 325 adjacent second seating receptacle 312. Seating surface 850, which may be substantially similar to seating surface 612, may be used to accommodate a kayak occupant. Seating surface 850 is typically suitable for accommodating an occupant who is small in size, such as a child, short adult, or an animal.

In some examples, the straps and/or loops described above may be color-coded to inform a user which straps should be coupled to which loops in order to achieve a desired configuration (e.g., a single-seat or tandem configuration).

C. Illustrative Adjustable Seat Back

Figure 25:
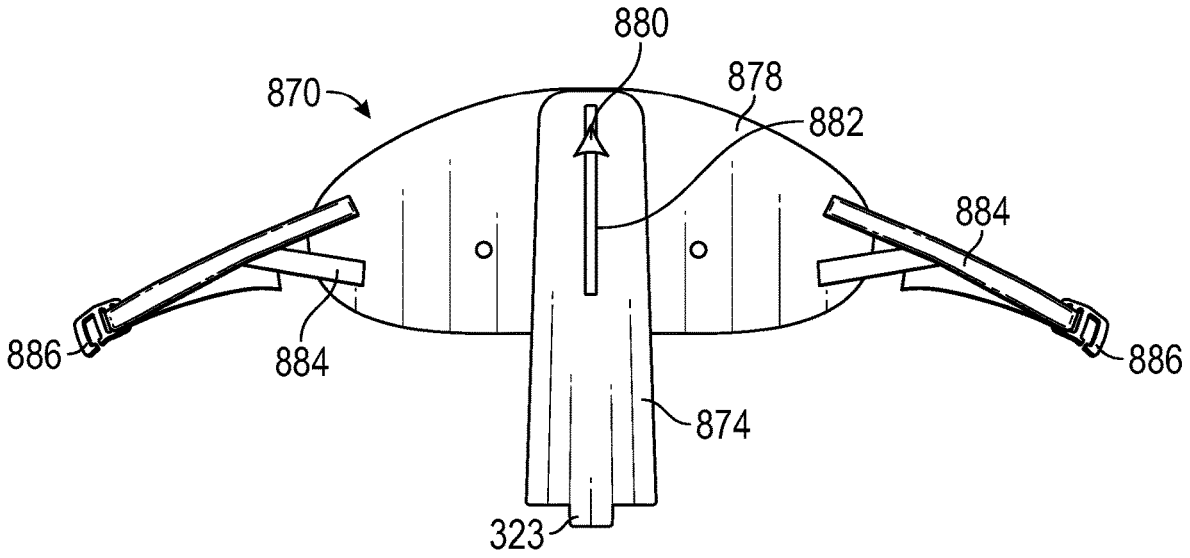
FIG. 25 is a back view depicting an illustrative adjustable seat installable in a foldable kayak, in accordance with aspects of the present teachings.

With reference to FIG. 25, this section describes an illustrative adjustable seat back 870 in accordance with aspects of the present teachings. Adjustable seat back 870 is another example of a seat back suitable for use in kayak 100 (e.g., for use in first seat assembly 600, second seat assembly 700, and/or third seat assembly 750).

As shown in a back view in FIG. 25, adjustable seat back 870 includes a seat column 874 and a seat backrest 878 slidably attached to the seat column. Specifically, seat column 874 has a slot 882, and seat backrest 878 is coupled to the seat column by a threaded fastener 880 extending transversely through the slot. With threaded fastener 880 loosely coupling seat backrest 878 to seat column 874, a user can slide the backrest into a desired position and then tighten the threaded fastener to secure the backrest in the desired position. In this manner, seat back 870 may be adjusted to accommodate preferences of different users, or of a same user in different situations. Seat column 874 further includes a tab 323 configured to fit within a slot in one of the kayak seat receptacles, to attach the seat back to the corresponding floorboard of the kayak.

A respective strap 884 is coupled to each lateral side of seat backrest 878, and a hook 886 is coupled to each strap. Hook 886 may be substantially similar to hook 624 in at least some respects.

D. Illustrative Stowed Configuration

Figure 26:
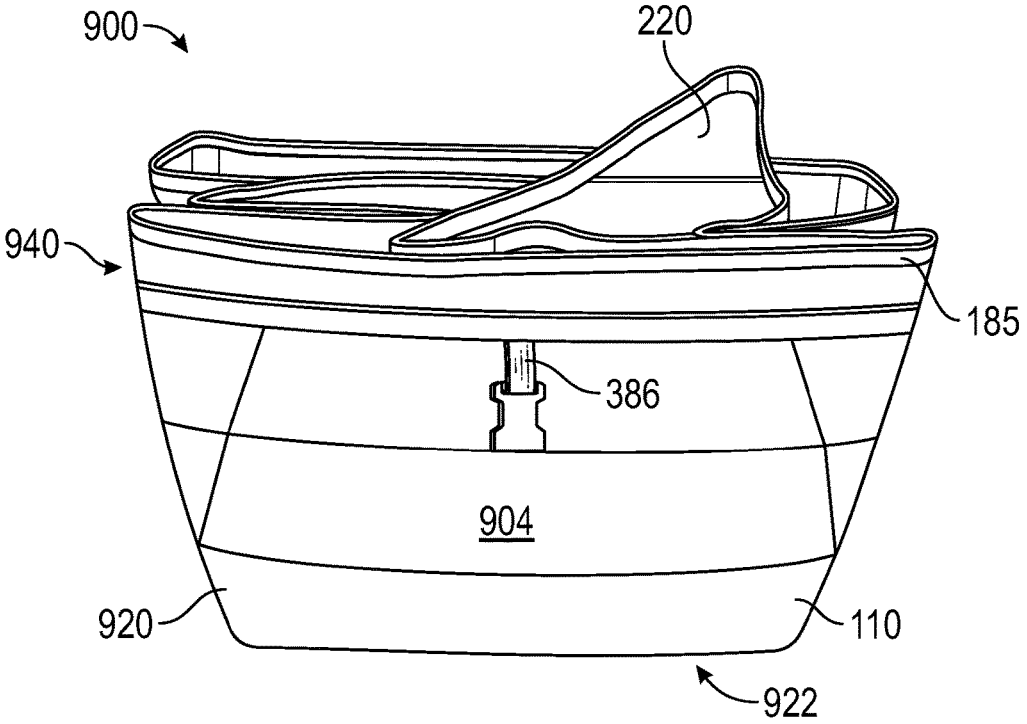
FIG. 26 is an isometric view depicting the kayak of FIG. 2 folded into a stowed configuration, in accordance with aspects of the present teachings.
Figure 27:
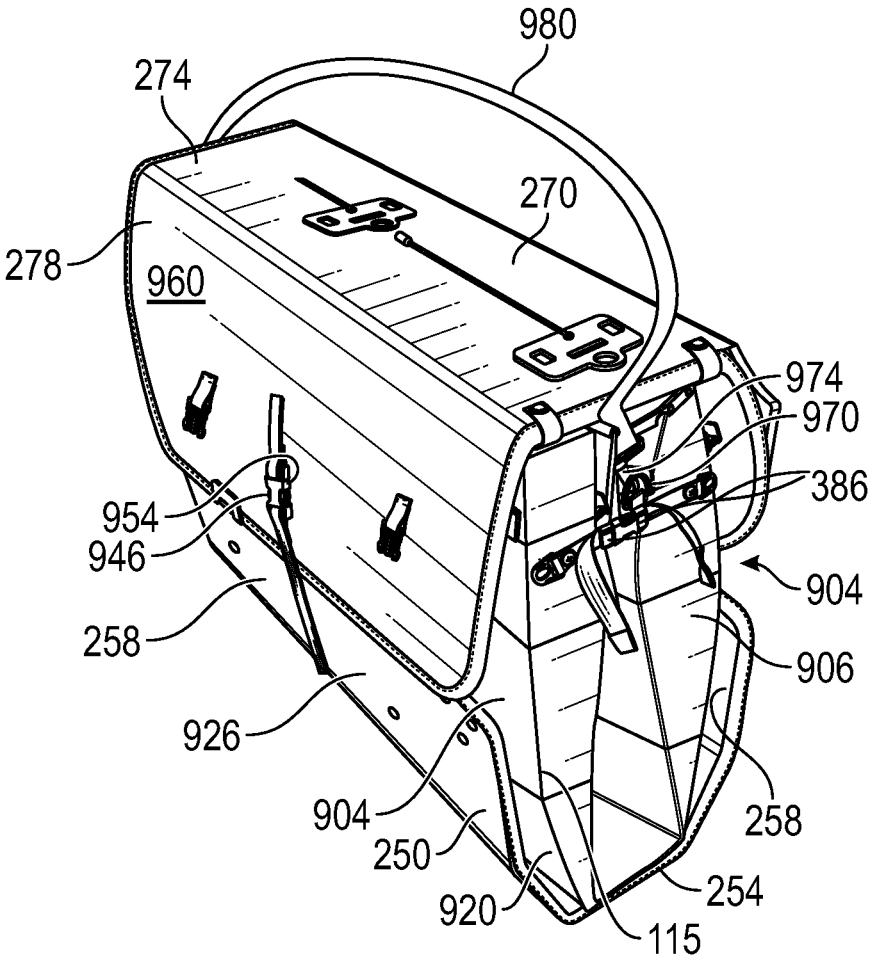
FIG. 27 is an isometric view depicting the kayak of FIG. 2 folded into the stowed configuration with the bow and stern floorboards secured around the folded foldable sheet to form a carrying case, in accordance with aspects of the present teachings.

With reference to FIGS. 26-27, this section describes an illustrative stowed configuration of kayak 100 in accordance with aspects of the present teachings. The stowed configuration may also be referred to as a folded configuration or state, a stored configuration or state, a box configuration or state, or a collapsed configuration or state.

FIG. 26 is a front isometric view of kayak 100 in the stowed configuration. In the stowed configuration, foldable sheet 110 takes the form of a generally rectangular box or prism, indicated in FIGS. 26-27 at 900. Box 900 has two opposing sides 904, where foldable sheet 110 may be slightly bulged, and two opposing folded sides 906 (see FIG. 27). Folded sides 906 correspond to folded portions of midship portion 125.

To achieve the stowed configuration, foldable sheet 110 is folded along predefined fold lines 115. Midship cockpit flaps 150, rear cockpit flaps 166, and front cockpit flaps 176 are angled substantially upward (e.g., they are bent slightly or not at all relative to the corresponding gunwale panels), such that resilient edge fittings 185 present a relatively even, stable surface at the top of the box.

In FIG. 26, fin 220 is depicted extending above box 900 for illustrative purposes, but in the stowed configuration fin 220 is typically folded down into the box (e.g., between other portions of the folded foldable sheet). As may be understood from FIG. 26, fin 220 is relatively small compared to the box and may be tucked into the box without significantly adding to the width of the box.

As shown in FIG. 27, which is an isometric view, bow and stern floorboards 250 and 270 are securable around the top and bottom of the folded foldable sheet to form a protective carrying case for the stowed kayak. Bow floorboard 250 is wrapped around a bottom portion 920 of the box, such that medial portion 254 engages a bottom surface 922 of the box, and lateral portions 258 each engage one of the sides 904 of the box.

Typically, bow floorboard 250 is wrapped around bottom portion 920 such that attachment hardware components such as seat receptacle 310 are facing and/or engaging box 900. This helps to protect the attachment hardware and any graphics while the kayak is in the stowed configuration. In some examples, however, bottom portion 920 is positioned with the attachment hardware facing outward.

In the stowed configuration, two of the straps 386 disposed on midship gunwale panels 147 are positioned on respective sides 904 of box 900. These two straps 386 are selectively attachable to a pair of straps 924 (see FIG. 7) attached to an outer lateral surface 926 (see FIG. 27) of each lateral portion 258 of bow floorboard 250. Coupling straps 924 to a respective one of straps 386 secures the bow floorboard to box 900. Straps 386, as described above, are configured to couple to floorboard buckles 387 in the assembled configuration (see FIG. 11). In other examples, however, the straps coupled to buckles 924 in the stowed configuration are different straps (e.g., one or both straps are unused in the assembled configuration).

Stern floorboard 270 is wrapped around a top portion 940 of box 900, such that medial portion 274 engages edge fittings 185 and lateral portions 278 each engage one of the sides 904 of the box. In the example depicted in FIGS. 26-27, lateral portions 278 of stern floorboard 270 partially overlap lateral portions 258 of bow floorboard 250 in the stowed configuration, but in other examples the floorboards do not overlap in the stowed configuration, which may result in slightly lesser overall width of the stowed configuration. In that case, opposing edges the floorboards may abut each other, or there may be a gap between the opposing edges of the floorboards. A second pair of buckles 946 attached to outer lateral surfaces 926 of bow floorboard 250 engage a third pair of buckles 954 attached to outer lateral surfaces 960 of lateral portions 278 of stern floorboard 270, thereby securing the stern floorboard around the box.

Two pairs of the straps 386 disposed at folded sides 906 of box 900 may be buckled together to further secure foldable sheet 110 in the folded configuration. The straps may be buckled together with the straps slack and then tightened to compress box 900 to a more compact size. In some examples, some or all of the side straps are rotatable (e.g., about a fastener connecting the strap to foldable sheet 110) to facilitate use in either the deployable or stowed configurations.

A respective ring 970 attached to foldable sheet 110 and/or to side buckles 386 is configured to be releasably coupled to a clasp 974 of an optional shoulder strap 980, which may be used to carry the kayak in the stowed configuration.

Components of seat assemblies, footrests, bulkheads, and/or any other suitable components of kayak 100 may be inserted into box 900 (e.g., between folds of folded foldable skin 110) before stern floorboard 270 is coupled to the box.

E. Illustrative Combinations and Additional Examples

This section describes additional aspects and features of a collapsible watercraft, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A0. A collapsible watercraft comprising:

a foldable sheet configured to transition, by folding or unfolding along a plurality of predefined fold lines, between a stowed state and an assembled state wherein the foldable sheet forms a body of the watercraft;

a pair of midship side portions of the foldable sheet configured to define a cockpit when the foldable sheet is in the assembled state; and a first removable floorboard configured to overlap a fore portion of a cockpit floor and a second removable floorboard configured to overlap an aft portion of the cockpit floor;

wherein the first and second floorboards are configured to form opposing lids at least partially enclosing the foldable sheet when the foldable sheet is in the stowed state.

A1. The collapsible watercraft of claim A0, wherein the first and second floorboards each have a pair of lateral flaps hingedly connected to opposing lateral edges of the respective floorboard, and wherein the lateral flaps are each configured to extend upwardly from the respective floorboard to form inner side walls of the cockpit when the foldable sheet is in the assembled state.

A2. The collapsible watercraft of claim A1, further comprising a pair of longitudinal engagement profiles attached to the foldable sheet at the cockpit, each longitudinal engagement profile including a channel configured to receive a respective edge of one of the lateral flaps of one of the floorboards, thereby securing the floorboard to the foldable sheet.

A3. The collapsible watercraft of claim A1, wherein the lateral flaps of the first floorboard are configured to at least partially overlap the lateral flaps of the second floorboard to at least partially enclose the foldable sheet in the stowed state.

A4. The collapsible watercraft of claim A0, further comprising a plurality of first straps attached to the foldable sheet and configured to engage a predetermined one of a plurality of second straps attached to the first and second floorboards.

A5. The collapsible watercraft of claim A4, wherein predetermined ones of the plurality of first straps are couplable to each other to retain the foldable sheet in the stowed state.

B0. A collapsible watercraft transitionable between a collapsed state and a deployed state, the collapsible watercraft comprising:

a foldable sheet having a plurality of predefined creases, the foldable sheet forming a body of the collapsible watercraft in the deployed state, with deck panels of the foldable sheet foldable inwardly toward each other about a longitudinal axis of the foldable sheet and brought together to form the deployed state; and a fin portion hingedly connected to a first one of the deck panels of the foldable sheet at one of the predefined creases and configured to pivot about the crease when the collapsible watercraft is in the deployed state to selectively either partially overlap an opposing second one of the deck panels of the foldable sheet, or to expose an interior portion of the collapsible watercraft.

B1. The collapsible watercraft of claim B0, wherein the interior portion of the collapsible watercraft comprises a storage space defined between a stern portion of the foldable sheet and a removable bulkhead, and the fin portion covers the storage space when at least partially overlapping the second one of the deck panels of the foldable sheet.

B2. The collapsible watercraft of claim B1, further comprising a grooved receptacle nonreleasably attached to the stern portion of the foldable sheet and configured to receive the removable bulkhead.

C0. A foldable kayak having a body formed of a foldable skin, the foldable kayak comprising:

opposing midship side portions defining a cockpit, each midship side portion having fold lines defining a respective gunwale portion and a respective cockpit flap;

a first floorboard including a medial portion shaped to at least partially conform to a first portion of the body between the opposing midship side portions, and a pair of lateral portions each disposed on a respective side of the medial portion; and a pair of engagement members each configured to connect to one of the cockpit flaps and to one of the lateral portions of the first floorboard, such that a longitudinally extending space is defined between each of the lateral portions of the first floorboard and the corresponding midship side portion.

C1. The foldable kayak of claim C0, wherein each of the engagement members includes a longitudinally extending groove configured to engage an attachment portion of an accessory for the foldable kayak.

C2. The foldable kayak of claim C0, further comprising a second floorboard shaped to at least partially conform to a second portion of the body aft of the first portion of the body.

C3. The foldable kayak of claim C2, wherein the second floorboard includes a pair of creased lateral portions disposed on opposing sides of a tapered medial portion.

C4. The foldable kayak of claim C2, wherein the second floorboard is configured to selectively receive a seat at either of two seat receptacles disposed on the second floorboard, and the first floorboard is configured to selectively receive a seat at a seat receptacle disposed on the first floorboard.

D0. A collapsible watercraft formed of a foldable skin and transitionable between an assembled state and a stowed state, the foldable skin defining a body of the collapsible watercraft when the collapsible watercraft is in the assembled state, the collapsible watercraft comprising:

opposing midship side portions of the foldable skin defining a cockpit, a respective gunwale flap hingedly connected to each midship side portion, and a respective midship cockpit flap hingedly connected to each gunwale flap;

a removable floorboard having a central portion and a pair of lateral portions hingedly connected to opposing lateral edges of the central portion, wherein the central portion is configured to conform to a floor of the cockpit when the collapsible watercraft is in the assembled state; and a first pair of longitudinally extending engagement members each configured to releasably secure one of the midship cockpit flaps to one of the lateral portions of the floorboard, such that when the collapsible watercraft is in the assembled state, each lateral portion of the floorboard, the corresponding midship cockpit flap, and the corresponding gunwale flap together form a hollow beam extending along the cockpit.

D1. The collapsible watercraft of claim D0, wherein each of the engagement members includes a longitudinal channel configured to receive an edge of the corresponding lateral portion of the floorboard.

D2. The collapsible watercraft of claim D1, wherein each of the engagement members is non-releasably attached to the corresponding floorboard lateral portion.

D3. The collapsible watercraft of claim D1, wherein each of the engagement members is non-releasably attached to the corresponding midship cockpit flap.

D4. The collapsible watercraft of claim D3, further comprising a second pair of longitudinally extending engagement members nonreleasably attached to a pair of rear cockpit flaps, the rear cockpit flaps being disposed aft of the midship cockpit flaps, and each of the second pair of engagement members being configured to releasably secure one of the lateral portions of the floorboard.

E0. A foldable kayak having a body formed of a single foldable skin, the foldable kayak comprising:

a pair of cockpit outer side walls disposed on opposing sides of a cockpit; and a first floorboard configured to overlap a first portion of a cockpit floor and a second floorboard configured to overlap a second portion of the cockpit floor;

wherein the first floorboard has a first seat attachment device configured to releasably attach a first seat to the first floorboard, and the second floorboard has a second seat attachment device configured to releasably attach a second seat to the second floorboard.

E1. The foldable kayak of claim E0, wherein the second floorboard has a third seat attachment device configured to releasably attach at least a portion of a third seat to the second floorboard.

E2. The foldable kayak of claim E0, wherein each of the seat attachment devices includes a plate having a slot configured to receive an attachment portion of a seat back and a cord configured to retain a seat pad against the corresponding floorboard.

E3. The foldable kayak of claim E0, wherein the first and second floorboards each have a respective pair of lateral wing portions configured to extend upward to form opposing inner side walls of the cockpit, and wherein at least one of the pairs of lateral wing portions has a pair of attachment members configured to releasably attach to a footrest.

E4. The foldable kayak of claim E0, further comprising a pair of rod-support apertures attached to opposing lateral wing portions of the first floorboard, each rod-support aperture comprising a plate having a keyhole-shaped slot configured to retain a rod extending transversely across the cockpit, thereby reinforcing the cockpit.

F0. A collapsible watercraft configured to transition between a collapsed state and a deployed state, and configured to accommodate either a single-passenger seat assembly or a tandem seat assembly in the deployed state, the collapsible watercraft comprising:

a foldable sheet having a plurality of predefined creases, the foldable sheet forming a body of the collapsible watercraft in the deployed state;

a pair of opposing midship side portions of the foldable sheet defining a cockpit;

a first removable floorboard configured to sit in a first portion of the cockpit; and a second removable floorboard configured to sit in a second portion of the cockpit;

wherein the first removable floorboard is configured to selectively engage a first seat of the tandem seat assembly, and the second removable floorboard is configured to selectively engage either a second seat of the tandem seat assembly or a single seat of the single-passenger seat assembly.

F1. The collapsible watercraft of claim F0, further comprising a first footrest nonreleasably attached to the foldable sheet and selectively couplable to either a first attachment strap disposed on the first removable floorboard or a second attachment strap disposed on the second removable floorboard.

F2. The collapsible watercraft of claim F1, further comprising a second footrest nonreleasably attached to the first seat of the tandem seat assembly and configured to be suspended aft of the first seat of the tandem seat assembly by a pair of adjustable straps selectively couplable to a third attachment strap disposed on the second floorboard.

F3. The collapsible watercraft of claim F2, wherein the first, second, and third attachment straps each comprise a pair of loops.

Advantages, Features, and Benefits

The different illustrative aspects, embodiments, and examples of the collapsible watercraft described herein provide several advantages over known systems. For example, illustrative embodiments and examples described herein allow a collapsible watercraft that is transitionable between a single-seat configuration and a tandem configuration.

Additionally, and among other benefits, illustrative embodiments and examples described herein allow a collapsible kayak to be at least partially covered by its removable floorboards when the kayak is in the collapsed configuration. In this manner, the collapsed kayak is protected from damage (e.g., by impact from other objects, by UV radiation, etc.) without the need for a dedicated carrying case. This saves time and cost during manufacturing of the kayak, and may be more convenient for a user, who would otherwise need to find a place to store the carrying case while the kayak is in the deployed configuration.

Additionally, and among other benefits, illustrative embodiments and examples described herein allow removable floorboard(s) to be attached to the kayak skin in a way that allows more depth, width, and volume within the kayak than known methods.

Additionally, and among other benefits, illustrative embodiments and examples described herein allow a variable number of accessories to be attached to the watercraft via an integrated attachment system.

No known system or device can perform these functions. However, not all embodiments and examples described herein provide the same advantages or the same degree of advantage.

Conclusion

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A collapsible watercraft comprising:

a foldable sheet configured to transition, by folding or unfolding along a plurality of predefined fold lines, between a stowed state and an assembled state wherein the foldable sheet forms a body of the watercraft;

a pair of midship side portions of the foldable sheet configured to define a cockpit when the foldable sheet is in the assembled state; and a first removable floorboard configured to overlap a fore portion of a floor of the cockpit and a second removable floorboard configured to overlap an aft portion of the floor of the cockpit;

wherein the first and second floorboards are configured to form opposing lids at least partially enclosing the foldable sheet when the foldable sheet is in the stowed state.

2. The collapsible watercraft of claim 1, wherein the first and second floorboards each have a pair of lateral flaps hingedly connected to opposing lateral edges of the respective floorboard, and wherein the lateral flaps are each configured to extend upwardly from the respective floorboard to form inner side walls of the cockpit when the foldable sheet is in the assembled state.

3. The collapsible watercraft of claim 2, further comprising a pair of longitudinal engagement profiles attached to the foldable sheet at the cockpit, each longitudinal engagement profile including a channel configured to receive a respective edge of one of the lateral flaps of one of the floorboards, thereby securing the floorboard to the foldable sheet.

4. The collapsible watercraft of claim 2, wherein the lateral flaps of the first floorboard are configured to at least partially overlap the lateral flaps of the second floorboard to at least partially enclose the foldable sheet in the stowed state.

5. The collapsible watercraft of claim 1, further comprising a plurality of first straps attached to the foldable sheet and configured to engage a predetermined one of a plurality of second straps attached to the first and second floorboards.

6. The collapsible watercraft of claim 5, wherein predetermined ones of the plurality of first straps are couplable to each other to retain the foldable sheet in the stowed state.

7. The collapsible watercraft of claim 1, further comprising at least one engagement profile attached to one of the midship side portions, wherein a channel of the engagement profile is configured to receive a lateral-portion edge of one of the floorboards, and a longitudinally extending groove of the engagement profile is configured to allow attachment of an accessory.

8. A foldable watercraft having a body formed of a foldable skin, the foldable watercraft comprising:

a foldable sheet configured to transition, by folding or unfolding along a plurality of predefined fold lines, between a stowed state and an assembled state wherein the foldable sheet forms a body of the watercraft;

opposing midship side portions of the foldable sheet defining a cockpit, each midship side portion having fold lines defining a respective gunwale portion and a respective cockpit flap;

a first removable floorboard including a medial portion shaped to at least partially conform to a first portion of the body between the opposing midship side portions, and a pair of lateral portions each disposed on a respective side of the medial portion;

a second removable floorboard shaped to at least partially conform to a second portion of the body aft of the first portion of the body; and a pair of engagement members each configured to connect to one of the cockpit flaps and to one of the lateral portions of the first floorboard, such that a longitudinally extending space is defined between each of the lateral portions of the first floorboard and the corresponding midship side portion;

wherein each of the engagement members includes a longitudinally extending groove configured to engage an attachment portion of an accessory for the foldable watercraft.

9. The foldable watercraft of claim 8, wherein the second floorboard includes a pair of creased lateral portions disposed on opposing sides of a tapered medial portion.

10. The foldable watercraft of claim 8, wherein the second floorboard is configured to selectively receive a seat at either of two seat receptacles disposed on the second floorboard, and the first floorboard is configured to selectively receive a seat at a seat receptacle disposed on the first floorboard.

11. The foldable watercraft of claim 8, wherein the groove is configured to engage an accessory chosen from the set consisting of a camera, a fishing rod, a firearm, binoculars, and a basket.

12. The foldable watercraft of claim 8, wherein the first and second floorboards are configured to form opposing lids at least partially enclosing the foldable sheet when the foldable sheet is in the stowed state.

13. A foldable watercraft comprising:

a foldable sheet configured to transition, by folding or unfolding along a plurality of predefined fold lines, between a stowed state and an assembled state wherein the foldable sheet forms a body of the watercraft and a cockpit of the watercraft including a pair of cockpit outer side walls disposed on opposing sides of a cockpit floor; and a first removable floorboard configured to overlap a first portion of the cockpit floor and a second removable floorboard configured to overlap a second portion of the cockpit floor;

wherein the first floorboard has a first seat attachment device configured to releasably attach a first seat to the first floorboard, and the second floorboard has a second seat attachment device configured to releasably attach a second seat to the second floorboard; and wherein the first floorboard is configured to selectively engage a first seat of a tandem seat assembly, and the second floorboard is configured to selectively engage either a second seat of the tandem seat assembly or a single seat of a single-passenger seat assembly.

14. The foldable watercraft of claim 13, wherein the second floorboard has a third seat attachment device configured to releasably attach at least a portion of a third seat to the second floorboard.

15. The foldable watercraft of claim 13, wherein each of the seat attachment devices includes a plate having a slot configured to receive an attachment portion of a seat back and a cord configured to retain a seat pad against the corresponding floorboard.

16. The foldable watercraft of claim 13, wherein the first and second floorboards each have a respective pair of lateral wing portions configured to extend upward to form opposing inner side walls of the cockpit, and wherein at least one of the pairs of lateral wing portions has a pair of attachment members configured to releasably attach to a footrest.

17. The foldable watercraft of claim 13, further comprising a pair of rod-support apertures attached to opposing lateral wing portions of the first floorboard, each rod-support aperture comprising a plate having a keyhole-shaped slot configured to retain a rod extending transversely across the cockpit, thereby reinforcing the cockpit.

18. The foldable watercraft of claim 13, further comprising a first footrest nonreleasably attached to the foldable sheet and selectively couplable to either a first attachment strap disposed on the first removable floorboard or a second attachment strap disposed on the second removable floorboard.

19. The foldable watercraft of claim 18, further comprising a second footrest nonreleasably attached to the first seat of the tandem seat assembly and configured to be suspended aft of the first seat of the tandem seat assembly by a pair of adjustable straps selectively couplable to a third attachment strap disposed on the second floorboard.

20. A foldable watercraft comprising:

a foldable sheet configured to transition, by folding or unfolding along a plurality of predefined fold lines, between a stowed state and an assembled state wherein the foldable sheet forms a body of the watercraft and a cockpit of the watercraft including a pair of cockpit outer side walls disposed on opposing sides of a cockpit floor; and a first removable floorboard configured to overlap a first portion of the cockpit floor and a second removable floorboard configured to overlap a second portion of the cockpit floor;

wherein the first floorboard has a first seat attachment device configured to releasably attach a first seat to the first floorboard, and the second floorboard has a second seat attachment device configured to releasably attach a second seat to the second floorboard; and wherein each of the seat attachment devices includes a plate having a slot configured to receive an attachment portion of a seat back and a cord configured to retain a seat pad against the corresponding floorboard.

* * * * *